US012227920B2

(12) United States Patent
Kameoka et al.

(10) Patent No.: US 12,227,920 B2
(45) Date of Patent: Feb. 18, 2025

(54) CONSTRUCTION MACHINE

(71) Applicant: HITACHI CONSTRUCTION MACHINERY CO., LTD., Tokyo (JP)

(72) Inventors: Ryota Kameoka, Ishioka (JP); Shinji Nishikawa, Kasumigaura (JP); Akihiro Narazaki, Tsukuba (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 399 days.

(21) Appl. No.: 17/760,513

(22) PCT Filed: Dec. 10, 2020

(86) PCT No.: PCT/JP2020/046142
§ 371 (c)(1),
(2) Date: Mar. 15, 2022

(87) PCT Pub. No.: WO2021/131761
PCT Pub. Date: Jul. 1, 2021

(65) Prior Publication Data

US 2022/0349153 A1 Nov. 3, 2022

(30) Foreign Application Priority Data

Dec. 27, 2019 (JP) ..... 2019-238919

(51) Int. Cl.
*E02F 9/24* (2006.01)
*E02F 3/43* (2006.01)
(Continued)

(52) U.S. Cl.
CPC ..... *E02F 9/24* (2013.01); *E02F 3/435* (2013.01); *E02F 9/0866* (2013.01);
(Continued)

(58) Field of Classification Search
CPC ..... E02F 3/435; E02F 9/0866; E02F 9/2033; E02F 9/2066; E02F 9/2203; E02F 9/2232;
(Continued)

(56) References Cited

U.S. PATENT DOCUMENTS 11,208,788 B2 12/2021 Izumikawa
11,346,085 B2 * 5/2022 Fujiwara ..... E02F 9/262
(Continued)

FOREIGN PATENT DOCUMENTS

JP 2005-113719 A 4/2005
JP 2013-023945 A 2/2013
(Continued)

OTHER PUBLICATIONS

Chinese Office Action received in corresponding Chinese Application No. 202080065231.4 dated Nov. 9, 2022.
(Continued)

*Primary Examiner* — Tyler J Lee
(74) *Attorney, Agent, or Firm* — MATTINGLY & MALUR, PC

(57) ABSTRACT

Both a control for limiting operation of a machine body and a control for raising engine speed are achieved when an obstacle is detected. To this end, a machine controller performs operation limiting control by conducting a control for reducing the speed of the engine when the machine body does not require engine speed increase control and an obstacle is sensed by obstacle sensors, and the machine controller performs supply flow rate reduction control for reducing the flow rates of the hydraulic fluid supplied to hydraulic actuators from a hydraulic pump when the machine body requires the engine speed increase control and an obstacle is sensed by the obstacle sensors.

7 Claims, 16 Drawing Sheets

(51) Int. Cl.

| | |
|---|---|
| ***E02F 9/08*** | (2006.01) |
| ***E02F 9/20*** | (2006.01) |
| ***E02F 9/22*** | (2006.01) |
| ***E02F 9/26*** | (2006.01) |

(52) U.S. Cl.
CPC ..... *E02F 9/2033* (2013.01); *E02F 9/2203* (2013.01); *E02F 9/2232* (2013.01); *E02F 9/2246* (2013.01); *E02F 9/226* (2013.01); *E02F 9/2267* (2013.01); *E02F 9/262* (2013.01)

(58) Field of Classification Search
CPC ..... E02F 9/2246; E02F 9/226; E02F 9/2267; E02F 9/24; E02F 9/262
See application file for complete search history.

(56) References Cited

U.S. PATENT DOCUMENTS

2003/0151508 A1* 8/2003 Frame ..... B66C 15/045 340/8.1
2013/0088593 A1* 4/2013 Ishimoto ..... E02F 9/226 348/143
2013/0222573 A1* 8/2013 Onuma ..... E02F 9/24 348/82
2014/0088824 A1* 3/2014 Ishimoto ..... E02F 9/0841 348/148
2015/0066313 A1 3/2015 Hirozawa et al.
2015/0275483 A1* 10/2015 Tsukamoto ..... F16P 3/141 701/50
2018/0209122 A1 7/2018 Kiyota et al.

FOREIGN PATENT DOCUMENTS

| | | | |
|---|---|---|---|
| JP | 2013-204223 | A | 10/2013 |
| JP | 2014-218849 | A | 11/2014 |
| JP | 2017-172223 | A | 9/2017 |
| JP | 2018-017034 | A | 2/2018 |
| WO | 2017094627 | A1 | 6/2017 |
| WO | 2018105527 | A1 | 6/2018 |

OTHER PUBLICATIONS

International Search Report of PCT/JP2020/046142 dated Feb. 2, 2021.
International Preliminary Report on Patentability received in corresponding International Application No. PCT/JP2020/046142 dated Jul. 7, 2022.

* cited by examiner

CONSTRUCTION MACHINE

TECHNICAL FIELD

The present invention relates to a construction machine that limits swing and travel operations when an obstacle is detected in the surroundings.

BACKGROUND ART

In a construction machine such as a hydraulic excavator, a technology for avoiding approaching of a machine body to an obstacle in the surroundings when an obstacle (person or thing) is detected in the surroundings of the construction machine is described, for example, in Patent Document 1.

Patent Document 1 describes the technology in which, when an obstacle is detected in a predetermined range, engine speed is lowered and pump delivery flow rate is lowered to thereby limit the operation of the construction machine and to call for attention of the operator, thereby avoiding approaching of the machine body to the obstacle.

PRIOR ART DOCUMENT

Patent Document

Patent Document 1: JP-2014-218849-A

SUMMARY OF THE INVENTION

Problem to be Solved by the Invention

In a construction machine such as a hydraulic excavator, a control for raising the speed of the engine to thereby increase the warming-up speed at the time of starting, or a control of raising the temperature of an exhaust gas after-processing device to thereby regenerate a filter is conducted.

In Patent Document 1, even during such a control, engine speed is lowered to limit operation when an obstacle is detected, and, therefore, there is a possibility that the warming-up may not be performed normally or the performance of the exhaust gas after-processing device may be lowered. In addition, if the engine speed is lowered each time of detection of an obstacle during when a control for increasing the engine speed is conducted, change in the engine speed is repeated, and variation of engine sound would give discomfort to the operator. If a control for raising the engine speed is made to be effective even when an obstacle is detected, for avoiding such a problem, the engine speed is not lowered and, therefore, operation speed of the machine body is not lowered, thus it may become impossible to avoid approaching of the machine body to the obstacle in the surroundings.

It is an object of the present invention to provide a construction machine that can achieve both a control for limiting the operation of a machine body and a control for raising the engine speed when an obstacle is detected.

Means for Solving the Problem

To solve such a problem, according to the present invention, there is provided a construction machine comprising: an engine mounted on a machine body; a variable displacement hydraulic pump driven by the engine; a plurality of hydraulic actuators driven by an hydraulic fluid delivered from the hydraulic pump; a plurality of directional control valves that control the flow rates of the hydraulic fluid supplied to the hydraulic actuators from the hydraulic pump; an obstacle sensor that senses an obstacle in surroundings of the machine body; and a controller that performs operation limiting control for limiting operation of the machine body when the obstacle is sensed by the obstacle sensor, wherein the controller is configured to perform the operation limiting control by performing control for reducing the speed of the engine when the machine body does not require engine speed increase control for increasing the speed of the engine and the obstacle is sensed by the obstacle sensor, and perform the operation limiting control by performing supply flow rate reduction control for reducing the flow rates of the hydraulic fluid supplied to the plurality of hydraulic actuators from the hydraulic pump when the machine body requires the engine speed increase control and the obstacle is sensed by the obstacle sensor.

In the present invention configured as above, when the machine body requires engine speed increase control and an obstacle is sensed by the obstacle sensor, the controller performs operation limiting control by conducting supply flow rate reduction control which reduces the flow rates of the hydraulic fluid supplied from the hydraulic pump to the plurality of hydraulic actuators, and therefore, the operation limiting control can be performed without damaging the engine speed increase control, and thus both a control for limiting the operation of the machine body and a control for raising the engine speed can be achieved.

Advantages of the Invention

According to the present invention, when an obstacle is detected, both a control for limiting the operation of the machine body and a control for raising the engine speed can be achieved. Therefore, approaching of the machine body to an obstacle in the surroundings can be avoided even when engine speed increase control is being performed.

MODES FOR CARRYING OUT THE INVENTION

Embodiments of the present invention will be described below.

First Embodiment

<Construction Machine>

Figure 1:
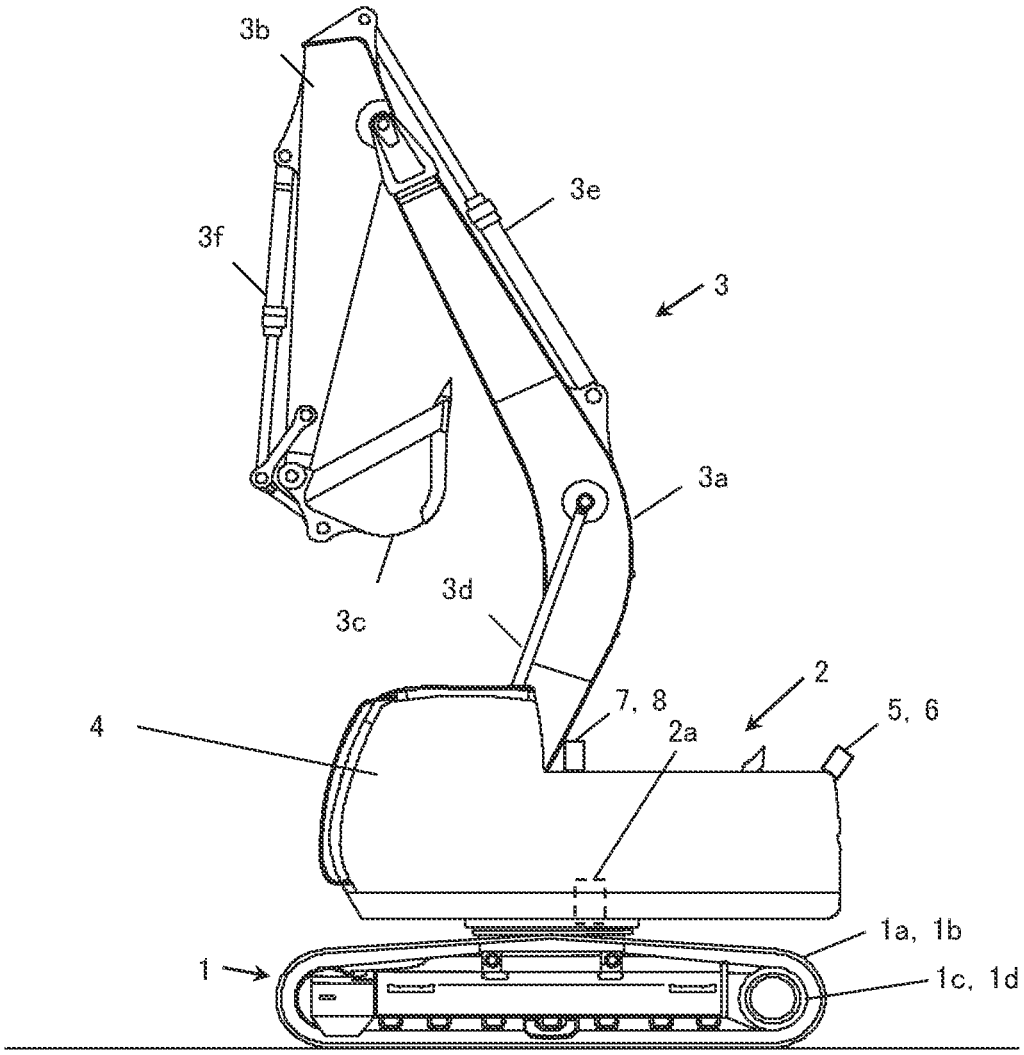
FIG. 1 is a diagram depicting an appearance of a hydraulic excavator as an example of a construction machine according to a first embodiment of the present invention.

FIG. 1 is a diagram depicting an appearance of a hydraulic excavator as an example of a construction machine according to a first embodiment of the present invention.

In FIG. 1, the hydraulic excavator (construction machine) includes a crawler-type lower travel structure 1, an upper swing structure 2 provided swingably relative to the lower travel structure 1, and a front work implement 3 coupled to a front part of the upper swing structure 2 rotatably upward and downward.

The lower travel structure 1 includes a pair of left and right travel hydraulic motors 1*c* and 1*d*, and left and right crawlers 1*a* and 1*b* are independently rotated by the travel hydraulic motors 1*c* and 1*d*, thereby to travel forward or backward.

The upper swing structure 2 includes: a cabin (operation room) 4 in which an operation lever devices 16, 17, and 18 (see FIG. 3) that performs various operations of the hydraulic excavator and an operation seat for seating the operator, and the like are disposed; the engine 19 (see FIG. 3); a hydraulic pump 21 (see FIG. 3) and a swing motor 2*a*; and the like, and is swung leftward or rightward relative to the lower travel structure 1 by the swing motor 2*a*. Other than Various measuring devices for the operator to confirm the status of the hydraulic excavator and a display device (not illustrated) for displaying machine information, the apparatuses described below are disposed in the cabin 4. Hereinafter, the hydraulic excavator (construction machine) as a whole may be referred to as the machine body.

The front work implement 3 includes a boom 3*a*, an arm 3*b*, and a bucket 3*c*, in which the boom 3*a* is moved upward or downward by a boom cylinder 3*d*, the arm 3*b* is operated to a dumping side (opening side) or a crowding side (shaveling-in side) by an arm cylinder 3*e*, and the bucket 3*c* is operated to a dumping side or a crowding side by a bucket cylinder 3*f*.

<Obstacle Sensor>

3D sensors 5, 6, 7, and 8 which are obstacle sensors for sensing an obstacle (operator or a person or a thing) in the surroundings of the machine body are mounted on a machine body rear end, a left side end, and a right side end of the hydraulic excavator. Here, "the machine body" means the upper swing structure 2. The 3D sensors 5, 6, 7, and 8 are infrared sensors of an optical pulse time-of-flight (TOF) system, determine detection/non-detection of an object in a predetermined detection range, and can output the determination results as a sensing signal by CAN communication. Note that as the obstacle sensor, other sensors than the 3D sensors 5, 6, 7, and 8 may be used.

<Detection Region of Obstacle Sensor>

Figure 2:
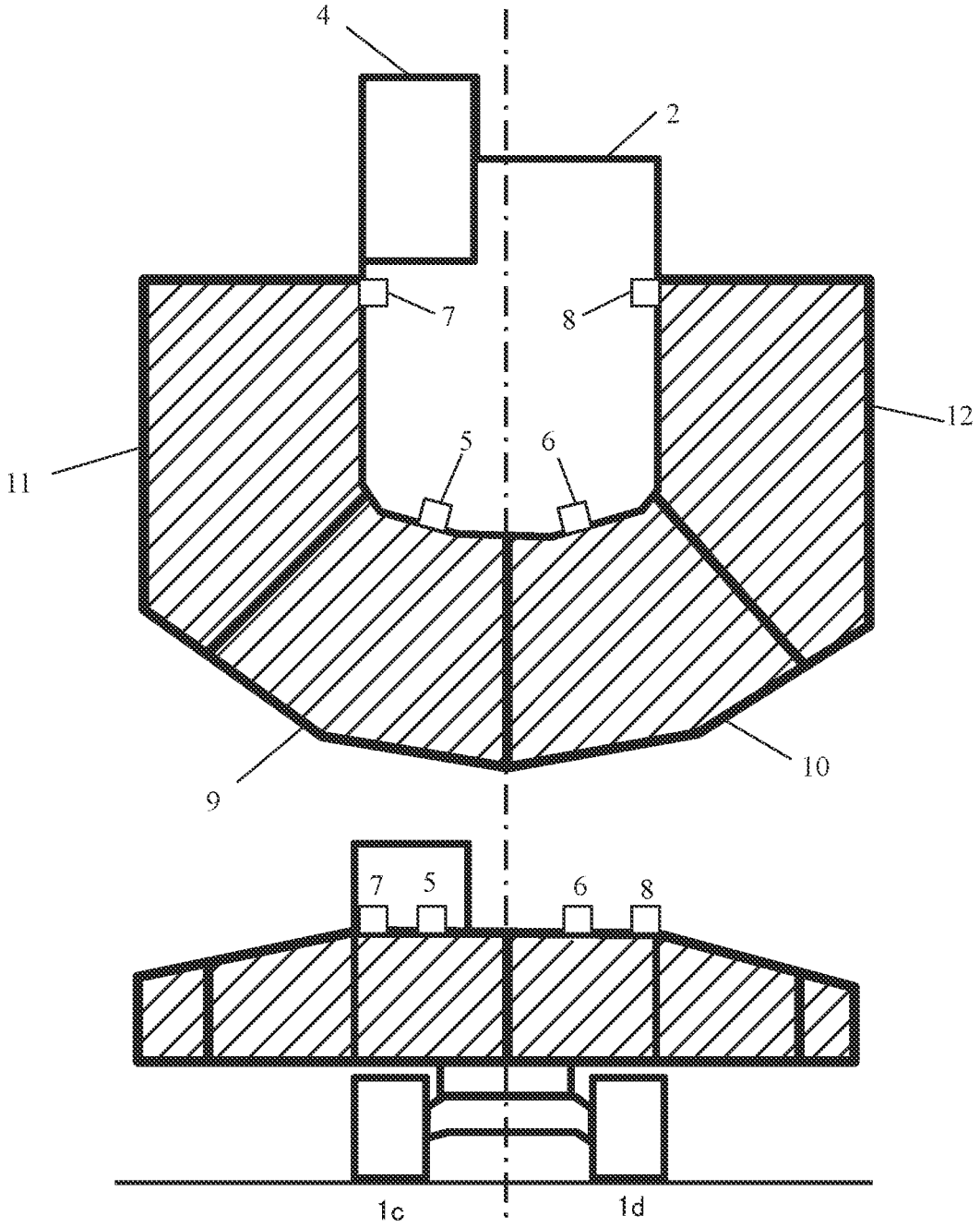
FIG. 2 is a diagram depicting a mounting position and a detection region of an obstacle sensor.

FIG. 2 is a diagram depicting a mounting position and a detection region of the obstacle sensor.

The 3D sensor 5 is mounted on a left side of an upper part rear end of the upper swing structure 2 of the hydraulic excavator, the 3D sensor 6 is mounted on a right side of an upper part rear end of the upper swing structure 2, the 3D sensor 7 is mounted in the vicinity of a center in the forward-backward direction of an upper part left side end of the upper swing structure 2, and the 3D sensor 8 is mounted in the vicinity of the center in the forward-backward direction of an upper part right side end of the upper swing structure 2. A wideness (angle) in which detection in the vertical direction and a horizontal direction are possible is set for the 3D sensors 5, 6, 7, and 8, and a space of the surroundings of the machine body from the vicinity of the center (for example, a rear end part of the cabin 4) in the forward-backward direction of an upper part right and left side ends of the upper swing structure 2 to the rear side can be covered by the detection ranges of the four 3D sensors 5, 6, 7, and 8.

By utilizing the detection ranges of these 3D sensors 5, 6, 7, and 8, detection regions for reducing the interference between the hydraulic excavator and an obstacle in the surroundings (a person such as the operator or a thing) at the time of starting an operation of the hydraulic excavator are set. In other words, the detection regions are set such that an obstacle present in the range in which the upper swing structure 2 moves in a short time of starting swing or travel of the hydraulic excavator can be sensed, in which the range sensed by the 3D sensor 5 is a detection region 9, the range sensed by the 3D sensor 6 is a detection region 10, the range sensed by the 3D sensor 7 is a detection region 11, and the range sensed by the 3D sensor 8 is a detection region 12. In addition, to prevent the detection regions 9, 10, 11, and 12 from sensing the crawlers of the lower travel structure 1 of the hydraulic excavator itself, the detection regions are set to be higher than a predetermined height.

<Sensing of Obstacle>

The 3D sensors 5, 6, 7, and 8 determines whether or not an obstacle is present in the respective detection regions, and the time when it is determined that one or more obstacles (persons or things) are present in each of the respective detection regions 9, 10, 11, and 12 is deemed as the time of sensing of the obstacle, and output sensing signals indicating the detected state of the detection regions 9, 10, 11, and 12.

<System Configuration>

Figure 3:
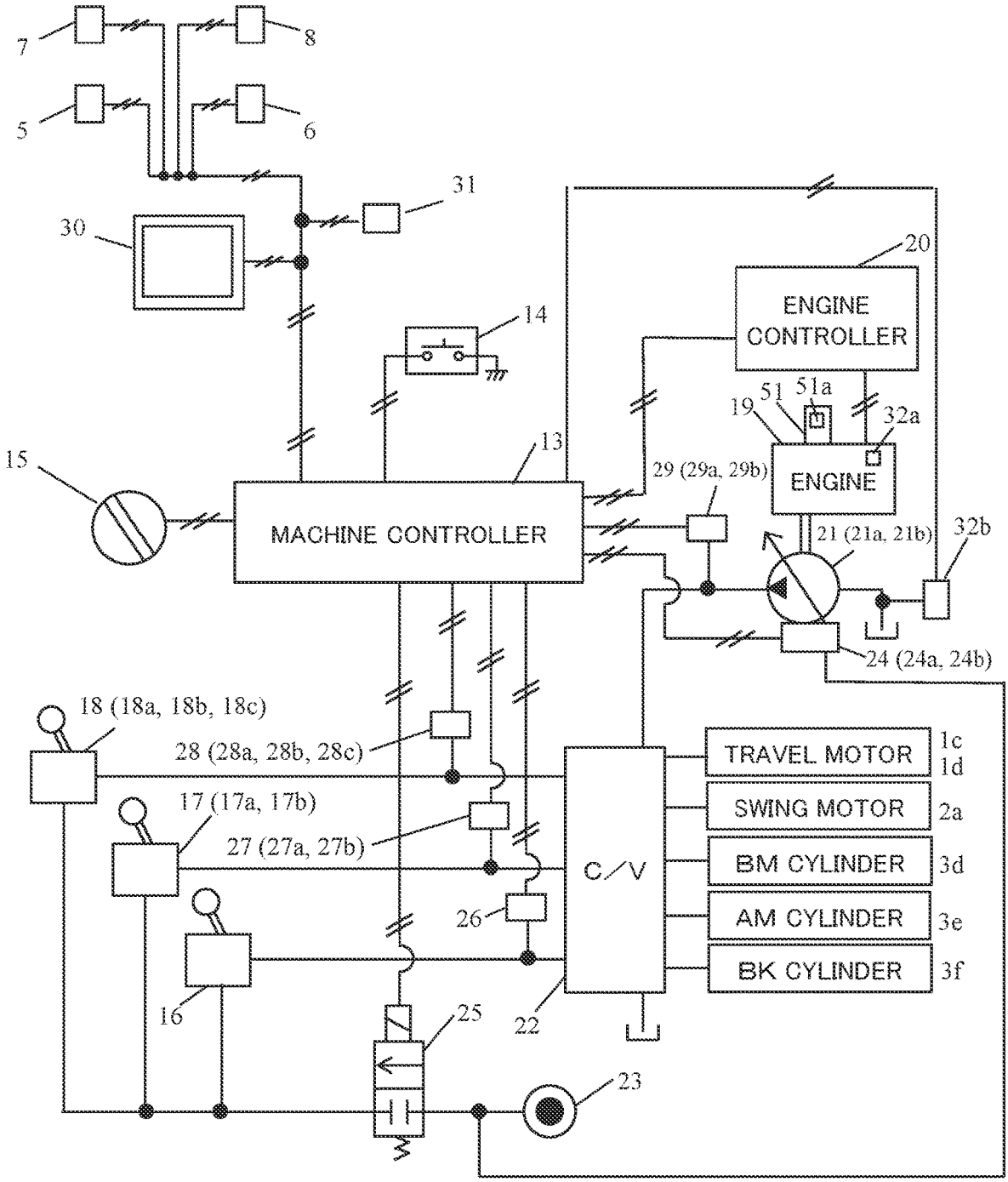
FIG. 3 is a diagram depicting the configuration concerning an operation limiting system of the first embodiment of the present invention.

FIG. 3 is a diagram depicting the configuration concerning an operation limiting system in the present embodiment.

A machine controller 13 (controller) for controlling the operation of the machine body as a whole, a lock switch 14 which is a lever type switch for changing over a lock valve 25 for changing over the operation acceptability of the hydraulic excavator, and an engine control dial 15 for manually changing over the speed of the engine 19 are disposed in the cabin 4 of the hydraulic excavator of the present embodiment.

In addition, operation devices for performing various operations of the hydraulic excavator are provided in the cabin 4 of the hydraulic excavator. In FIG. 3, as the operation devices, a swing operation lever device 16 and a travel operation lever device 17 and a front implement operation lever device 18 are depicted. The swing operation lever device 16 is an operation device for performing clockwise swing operation and counterclockwise swing operation. The travel operation lever device 17 includes an operation lever device 17*a* for performing a left forward travel operation and a left backward travel operation, and an operation lever device 17*b* for performing a right forward travel operation and a right backward travel operation; the front implement operation lever device 18 includes an operation lever device 18*a* for performing a boom raising operation and a boom lowering operation, an operation lever device 18*b* for performing an arm crowding operation and an arm dumping operation, and an operation lever device 18*c* for performing a bucket crowding operation and a bucket dumping operation. In FIG. 3, for convenience of explanation, the operation lever devices 17*a* and 17*b* are expressed representatively by the travel operation lever device 17, and the operation lever devices 18*a*, 18*b*, and 18*c* are expressed representatively by the front implement operation lever device 18.

The engine (diesel engine) 19 as a prime mover is mounted on the hydraulic excavator of the present embodiment, and the engine 19 is electrically connected to an engine controller 20. A water temperature sensor 32*a* for sensing the water temperature of a radiator and a pick-up sensor (rotation sensor) not illustrated are incorporated in the engine 19. In addition, an exhaust gas after-processing device 51 including a muffler filter for filtering soot contained in an exhaust gas is incorporated in the engine 19, and the exhaust gas after-processing device 51 includes a differential pressure sensor 51*a* for measuring the differential pressure across the muffler filter. Sensing signals of the water temperature sensor 32*a* and the pick-up sensor not illustrated and a sensing signal of the differential pressure sensor 51*a* of the exhaust gas after-processing device 51 are sent to the engine controller 20. The engine controller 20 monitors whether or not the differential pressure exceeds a threshold based on the sensing signal of the differential pressure sensor 51*a*, and, when the differential pressure exceeds the threshold, a flag (hereinafter referred to as muffler filter regeneration control flag) for performing muffler filter regeneration control for raising the temperature of the exhaust gas and combusting and removing particulate substance (soot) accumulated in the muffler filter is set.

The hydraulic pump 21 is a variable displacement hydraulic pump driven the engine 19, and the hydraulic fluid delivered by the hydraulic pump 21 passes through a control valve 22 incorporating a plurality of directional control valves, to be supplied to the travel motors 1*c* and 1*d*, the swing motor 2*a*, the boom cylinder 3*d*, the arm cylinder 3*a*, and the bucket cylinder 3*f* which are a plurality of hydraulic actuators.

Note that normally, two hydraulic pumps are mounted on the hydraulic excavator, in consideration of, for example, a status in which a plurality of hydraulic actuators are simultaneously operated. In FIG. 3, for convenience of illustration, only one hydraulic pump is depicted, and the hydraulic pump 21 is denoted by reference characters "21*a*" and "21*b*" to indicate that there are two hydraulic pumps 21.

In addition, of the two hydraulic pumps 21*a* and 21*b*, the hydraulic fluid delivered from the hydraulic pump 21*a* on one side (hereinafter referred to as the first hydraulic pump 21*a*) is used for driving the boom cylinder 3*d*, the arm cylinder 3*e*, the bucket cylinder 3*f*, and the right travel motor 1*d*, whereas the hydraulic fluid delivered from the hydraulic pump 21*b* on the other side (hereinafter referred to as the hydraulic pump 21*b*) is used for driving the left travel motor 1*c*, the swing motor 2*a*, the boom cylinder 3*d*, and the arm cylinder 3*e*.

The operation lever devices 16, 17, and 18 respectively incorporate pilot valves which are manual pressure reduction valves, and reduces a pilot primary pressure supplied from a pilot hydraulic fluid pressure source 23 according to an operation amount of a lever to generate a secondary pressure. The secondary pressure thus generated moves a plurality of spools as the directional control valves provided in the control valve 22, thereby adjusting the flow (flow rate and flow direction) of the hydraulic fluid delivered from the hydraulic pumps 21, to control the driving speeds and driving directions of the corresponding hydraulic actuators.

The pilot hydraulic fluid pressure source 23 includes a pilot pump (not illustrated) driven by the engine 19, and a pilot relief valve (not illustrated) that keeps constant (4 MPa) the delivery pressure of the pilot pump to generate the pilot primary pressure. The pressure (pilot primary pressure) of the pilot hydraulic fluid pressure source 23 is supplied to a regulator 24 and the lock valve 25 of the hydraulic pump 21, and further supplied to the pilot valves of the operation lever devices 16, 17, and 18 through the lock valve 25.

The pump regulator 24 includes a pump flow rate control valve (not illustrated) which is a solenoid proportional valve for reducing the pilot primary pressure from the pilot hydraulic fluid pressure source 23, and the pump flow rate control valve reduces the pilot primary pressure according to a command current (mA) outputted by the machine controller 13, and generates a pump flow rate control pressure. In addition, the pump regulator 24 incorporates a tilting (displacement volume) control mechanism for the hydraulic pump 21, controls the displacement volume, or displacement, of the hydraulic pump 21 according to the pump flow rate control pressure generated by the pump flow rate control valve, and controls the delivery flow rate of the hydraulic pump 21.

The pump flow rate control valve of the pump regulator 24 has a characteristic such that it is located at an interruption position (0 MPa) at non-control time (0 mA) and that the pump flow rate control pressure increases as the machine controller 13 increases the command current. The pump regulator 24 includes a regulator 24*a* of the first hydraulic pump 21*a* and a regulator 24*b* of the second hydraulic pump 21*b*.

A swing operation pressure sensor 26 for sensing a pilot valve secondary pressure (hereinafter referred to as operation pressure) is provided in a pilot line between the swing operation lever device 16 and the control valve 22. A travel operation pressure sensor 27 for sensing a pilot valve secondary pressure (hereinafter referred to as operation pressure) is provided in a pilot line between the travel operation lever device 17 and the control valve 22. A front implement operation pressure sensor 28 for sensing a pilot valve secondary pressure (hereinafter referred to as operation pressure) is provided in a pilot line between the front implement operation lever device 18 and the control valve 22. Though illustration is omitted, the travel operation pressure sensor 27 includes a left travel operation pressure sensor 27*a* and a right travel operation pressure sensor 27*b*, whereas the front implement operation pressure sensor 28 includes a boom operation pressure sensor 28*a*, an arm operation pressure sensor 28*b*, and a bucket operation pressure sensor 28*c*.

Sensing signals of the swing operation pressure sensor 26, the travel operation pressure sensor 27 (that is, the left travel operation pressure sensor 27*a* and the right travel operation pressure sensor 27*b*), and the front implement operation pressure sensor 28 (that is, the boom operation pressure sensor 28*a*, the arm operation pressure sensor 28*b*, and the bucket operation pressure sensor 28*c*) are inputted to the machine controller 13, and the machine controller 13 grasps the operation status of the hydraulic excavator.

A pump delivery pressure sensor 29 for sensing the delivery pressure of the hydraulic pump 21 is provided in a hydraulic fluid supply line between the hydraulic pump 21 and the control valve 22. A sensing signal of the pump delivery pressure sensor 29 is inputted to the machine controller 13, and the machine controller 13 grasps the load on the hydraulic pump 21. The pump delivery pressure sensor 29 includes a pump delivery pressure sensor 29*a* of the first hydraulic pump 21*a* and a pump delivery pressure sensor 29*b* of the second hydraulic pump 21*b*.

A hydraulic fluid temperature sensor 32*b* for sensing the temperature of the hydraulic fluid is provided in a line between a suction port of the hydraulic pump 21 and the tank.

The machine controller 13 and the engine controller 20 are connected with each other through CAN communication, and each send and receive necessary information.

In regard of the engine speed control, the engine controller 20 transmits the aforementioned muffler filter regeneration control flag and a sensor value (water temperature sensor value) of the water temperature sensor 32*a* to the machine controller 13. The machine controller 13 receives as inputs the muffler filter regeneration control flag and the water temperature sensor value transmitted from the engine controller 20, a sensor value (hydraulic fluid temperature sensor value) of the hydraulic fluid temperature sensor 32*b*, sensing signals (obstacle detection state) of the 3D sensors 5, 6, 7, and 8, a command voltage value of the engine control dial, and sensor values (operation state of operation lever devices 16, 17, and 18) of the swing operation pressure sensor 26, the travel operation pressure sensor 27, and the front implement operation pressure sensor 28, and, based on these values/states, calculates a target engine speed (secondary target engine speed v4 described later), and transmits the thus calculated target engine speed (secondary target engine speed v4 described later) to the engine controller 20. The engine controller 20 computes an engine actual speed from the signal of the pick-up sensor, and controls a fuel injection valve and the like such that the engine actual speed becomes equal to the target engine speed, thereby to control the speed and output torque of the engine 19.

A surrounding detection monitor 30 and an alarm buzzer 31 for informing the operator of the detection information on the surroundings based on the sensing signals of the 3D sensors 5, 6, 7, and 8 and the limiting state of the machine body operation based on the detection information are provided in the cabin 4 of the hydraulic excavator.

The 3D sensors 5, 6, 7, and 8 and the surrounding detection monitor 30 and the machine controller 13 are connected with one another through CAN communication, and each send and receive necessary information. By the CAN communication, the machine controller 13 and the surrounding detection monitor 30 can find whether or not an obstacle is detected in each of the detection regions 9, 10, 11, and 12. Further, the machine controller 13 determines, when an obstacle (person or thing) is present in one or more of the detection regions 9, 10, 11, and 12 generated by the 3D sensors 5, 6, 7, and 8, that the obstacle is detected, and determines, when an obstacle (person or thing) is present in none of the detection regions, that the obstacle is not detected.

<Characteristics of Operation Limiting System>

The characteristics of the operation limiting system of the present embodiment will be summarized as follows.

In the present embodiment, the machine controller 13 is a controller that performs operation limiting control for limiting the operation of the machine body when an obstacle is sensed by the obstacle sensors (3D sensors 5, 6, 7, and 8). Further, the machine controller 13 performs, when the machine body does not require engine speed increase control for increasing the speed of the engine 19 and the obstacle sensors (3D sensors 5, 6, 7, and 8) sense an obstacle, a control of lowering the speed of the engine 19, thereby to perform operation limiting control for the machine body. When the machine body requires the engine speed increase control and the obstacle sensors (3D sensors 5, 6, 7, and 8) sense an obstacle or obstacles, the machine controller 13 performs supply flow rate reduction control of reducing the flow rate of the hydraulic fluid supplied to the plurality of hydraulic actuators 1*c* to 3*f* from the hydraulic pump 21, thereby to perform operation limiting control for the machine body.

Figure 7:
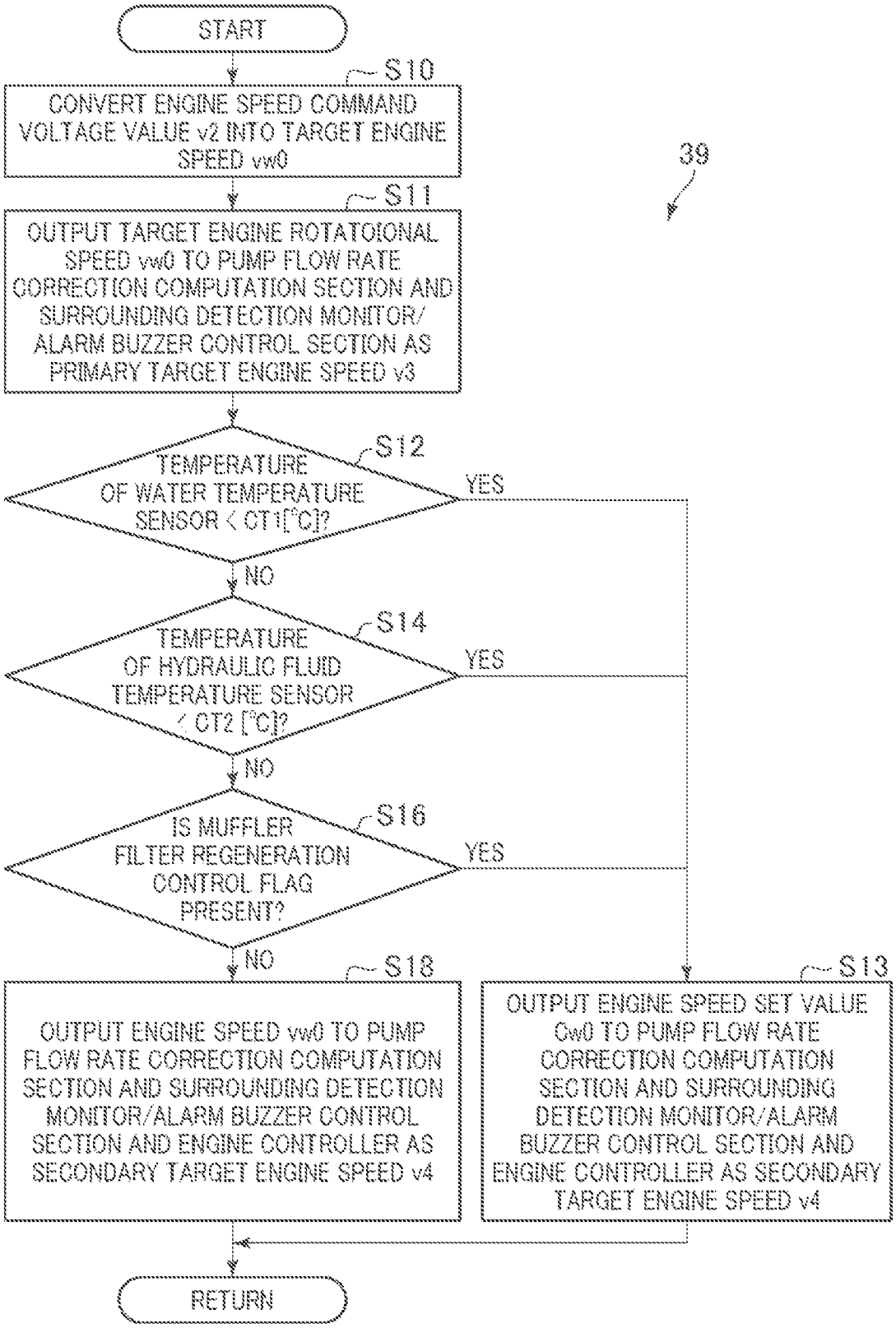
FIG. 7 is a flow chart depicting the processing contents of an engine speed control section.

Here, the aforementioned "the machine body does not require engine speed increase control for increasing the speed of the engine 19" corresponds to that the determination results of steps S12, S14, and S16 in FIG. 7 described later are NO, and the aforementioned "the machine body requires the engine speed increase control" corresponds to that the determination results of steps S12, S14, and S16 in FIG. 7 are YES. In other words, the aforementioned "the machine body does not require engine speed increase control for increasing the speed of the engine 19" means the case where none of water temperature worming-up control, hydraulic fluid warming-up control, and muffler filter regeneration control require engine speed increase control, and the aforementioned "the machine body requires the engine speed increase control" means the case where any one of the water temperature warming-up control, the hydraulic fluid temperature warming-up control, and the muffler filter regeneration control requires the engine speed increase control.

The construction machine further includes an alarm device (alarm buzzer 31) for generating an alarm sound, and the machine controller 13, when performing the supply flow rate reduction control, simultaneously operates the alarm device (alarm buzzer 31) to generate an alarm sound.

The engine speed increase control is at least one of water temperature increase control for increasing the temperature of cooling water circulated in the engine 19, hydraulic fluid warming-up control for raising the temperature of the hydraulic fluid which is a hydraulic fluid supplied to the plurality of hydraulic actuators 1*c* to 3*f* from the hydraulic pump 21, and exhaust gas temperature increase control for increasing the temperature of an exhaust gas of the engine 19 to regenerate the filter of the exhaust gas after-processing device 51.

The supply flow rate reduction control is a control for reducing the target displacement of the hydraulic pump 21 to reduce the delivery flow rate of the hydraulic pump 21.

The details will be described below.

<Machine Controller 13>

Figure 4:
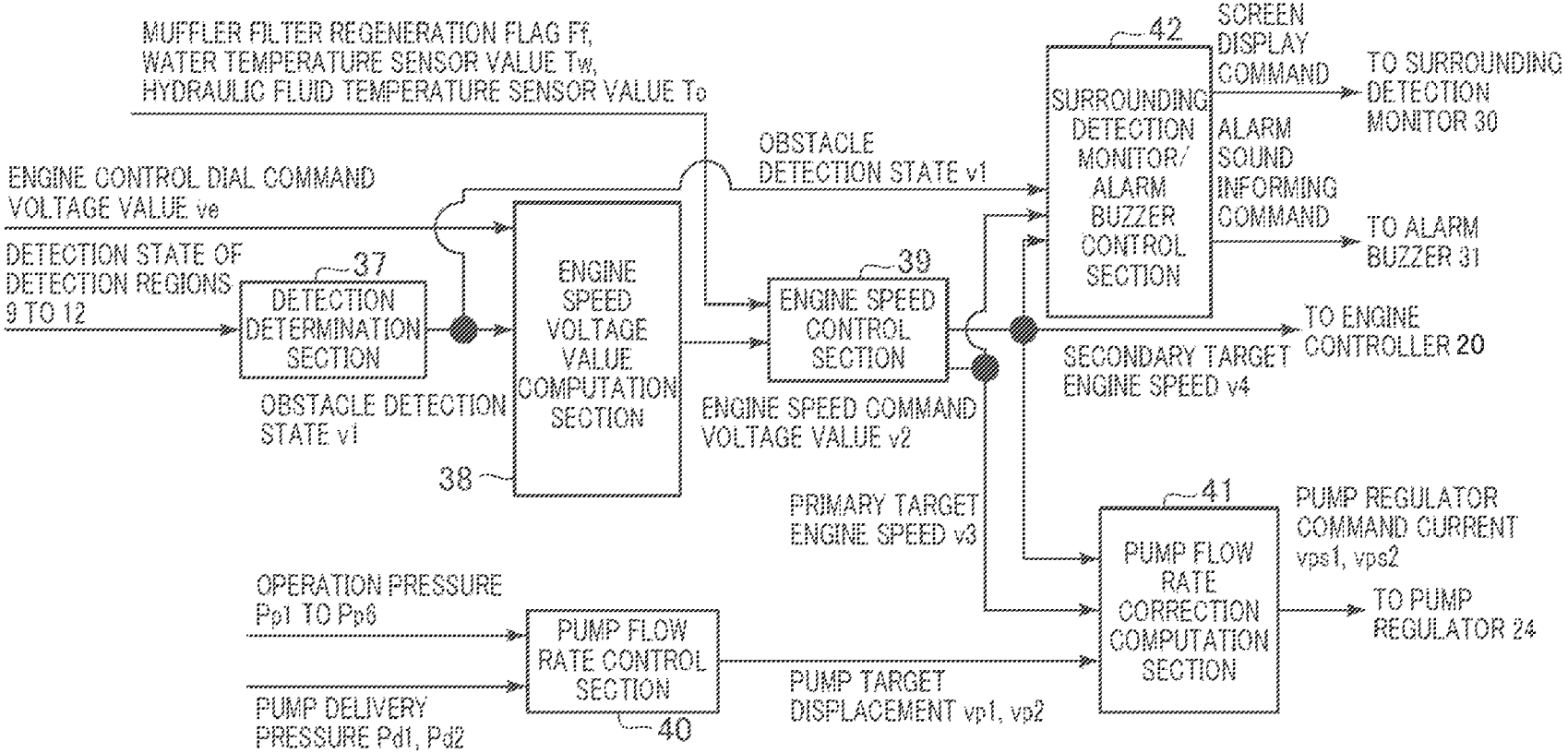
FIG. 4 is a block diagram depicting the processing contents of a machine controller in the first embodiment of the present invention.

FIG. 4 is a block diagram depicting the processing contents of the machine controller 13 in the present embodiment.

The machine controller 13 has a detection determination section 37, an engine speed voltage value computation section 38, an engine speed control section 39, a pump flow rate control section 40, a pump flow rate correction computation section 41, and a surrounding detection monitor/alarm buzzer control section 42, as control functions for limiting the operations of the machine body when an obstacle is sensed.

The detection determination section 37 determines whether or not an obstacle is detected in the detection regions 9 to 12 based on the sensing signals transmitted from the 3D sensors 5 to 8, and outputs the determination result as an obstacle detection state v1.

The engine speed voltage value computation section 38 calculates an engine speed command voltage value v2 based on a command voltage value ve from the engine control dial 15 and the obstacle detection state v1 from the detection determination section 37.

The engine speed control section 39 receives as inputs the engine speed command voltage value v2 calculated by the engine speed voltage value computation section 38, a muffler filter regeneration control flag Ff transmitted from the engine controller 20, a water temperature sensor value Tw which is a sensor value of the water temperature sensor 32*a*, and a hydraulic fluid temperature sensor value To which is a sensor value of the hydraulic fluid temperature sensor 32*b*, and calculates a primary target engine speed v3 and a secondary target engine speed v4, based on these state amounts.

The pump flow rate control section 40 receives operation pressures Pp1 to Pp6 (see FIG. 8) which are sensor values of the swing operation pressure sensor 26, the travel operation pressure sensor 27, and the front implement operation pressure sensor 28, and pump delivery pressures Pd1 and Pd2 (see FIG. 8) which are sensor values of the pump delivery pressure sensor 29 as inputs, and calculates pump target displacements vp1 and vp2.

The pump flow rate correction computation section 41 receives the primary target engine speed v3, the secondary target engine speed v4, and the pump target displacements vp1 and vp2 as inputs, corrects the pump target displacements vp1 and vp2 based on the primary target engine speed v3 and the secondary target engine speed v4, and outputs command currents vps1 and vps2 of the corrected pump target displacement to the regulators 24*a* and 24*b* of the hydraulic pumps 21*a* and 21*b*.

The surrounding detection monitor/alarm buzzer control section 42 receives the primary target engine speed v3, the secondary target engine speed v4, and the obstacle detection state v1 from the detection determination section 37 as inputs, and outputs a screen display command and an alarm sound informing command respectively to the surrounding detection monitor 30 and the alarm buzzer 31.

In addition, the engine speed control section 39 outputs the secondary target engine speed v4 to the engine controller 13.

The processing of each section will be described specifically below.

<Detection Determination Section 37>

Figure 5:
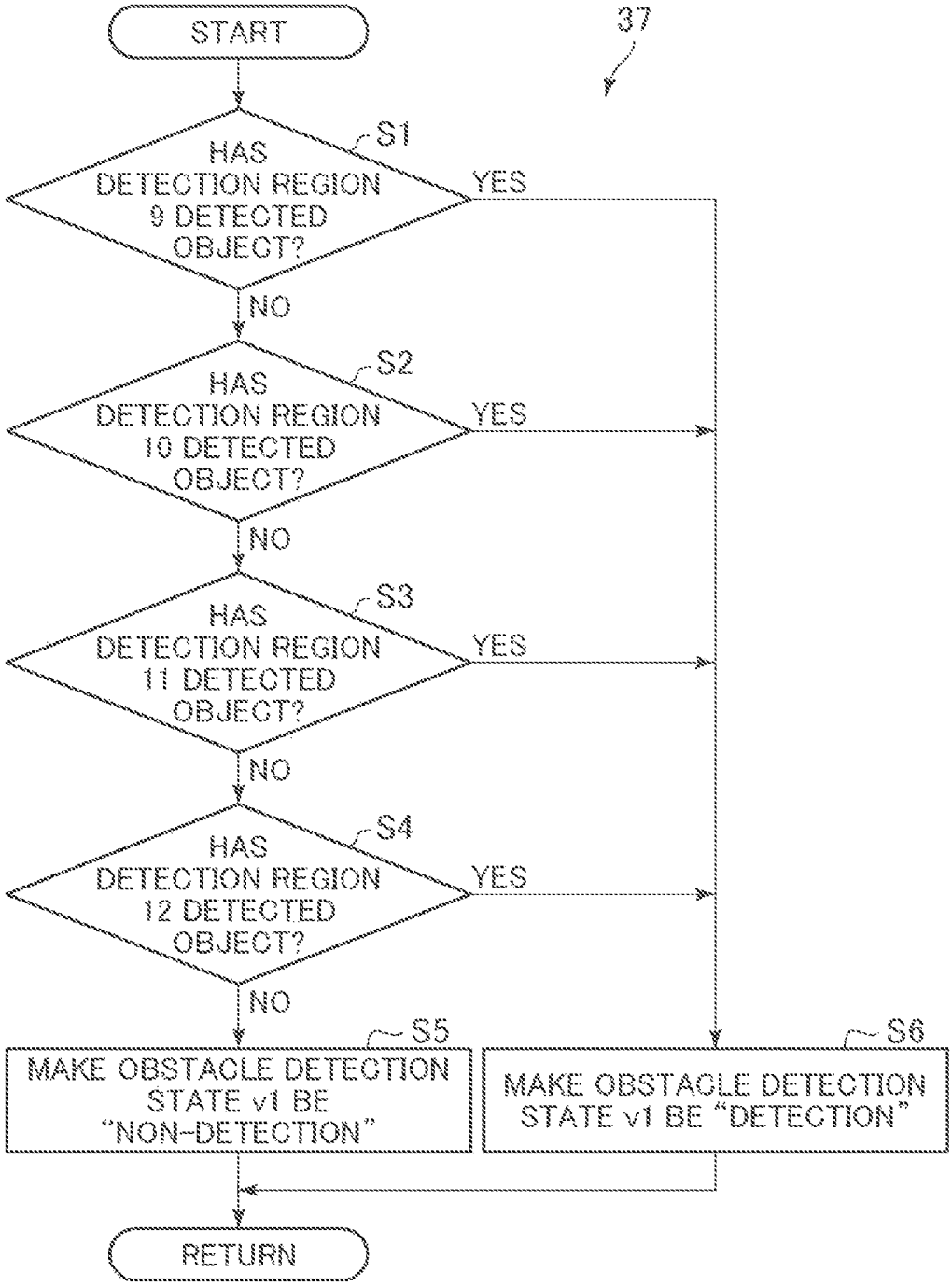
FIG. 5 is a flow chart depicting the processing contents of a detection determination section.

FIG. 5 is a flow chart depicting the processing contents of the detection determination section 37.

In FIG. 5, the detection determination section 37 first determines whether or not an object (person or thing) is detected in the detection region 9, based on the sensing signal transmitted from the 3D sensor 5 (step S1). When the object is detected in the detection region 9, it is determined as a detection state of an obstacle, and the obstacle detection state v1 as a variable is made to be "detection" (step S6).

When the object is not detected in the detection region 9, it is determined whether or not an object is detected in the detection region 10 transmitted from the 3D sensor 6 (step S2). When the object is detected in the detection region 10, it is determined as a detection state of the obstacle, and the obstacle detection state v1 as a variable is made to be "detection" (step S6).

When the object is not detected in the detection region 10, it is determined whether or not an object is detected in the detection region 11 transmitted from the 3D sensor 7 (step S3). When the object is detected in the detection region 11, it is determined as a detection state of the obstacle, and the obstacle detection state v1 as a variable is made to be "detection" (step S6).

When the object is not detected in the detection region 11, it is determined whether or not an object is detected in the detection region 12 transmitted from the 3D sensor 8 (step S4). When the object is detected in the detection region 12, it is determined as a detection state of the obstacle, and the obstacle detection state v1 as a variable is made to be "detection" (step S6).

When an object is detected in none of the detection regions 9, 10, 11, and 12, it is determined as a non-detection state of the obstacle, and the obstacle detection state v1 as a variable is made to be "non-detection" (step S5).

<Engine Speed Voltage Value Computation Section 38>

Figure 6:
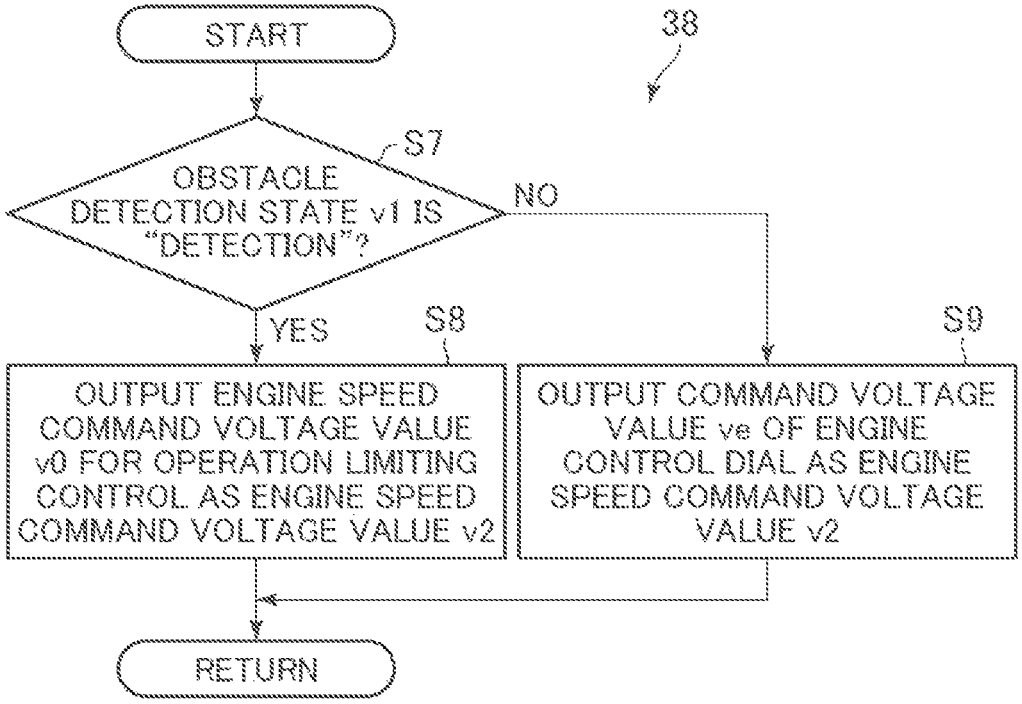
FIG. 6 is a flow chart depicting the processing contents of an engine speed voltage value computation section.

FIG. 6 is a flow chart depicting the processing contents of the engine speed voltage value computation section 38.

In FIG. 6, the engine speed voltage value computation section 38 determines whether or not the obstacle detection state v1 inputted from the detection determination section 37 is a "detection" state (step S7), and, when the obstacle detection state v1 is the "detection" state, outputs a preset engine speed command voltage value v0 for operation limiting control (engine speed limiting control) to the engine speed control section 39, as the engine speed command voltage value v2 (step S8), whereas when the obstacle detection state v1 is a "non-detection" state, outputs the command voltage value ve of the engine control dial 15 to the engine speed control section 39, as the engine speed command voltage value v2 (step S9).

<Engine speed Control Section 39>

The engine speed control section 39 calculates a target engine speed for performing a speed control for the engine 19 based on the command voltage value ve from the engine control dial 15, a speed increase control for the engine 19 based on a require from the machine body, and a speed limiting control (speed reduction control) for the engine 19 based on the detection state of an obstacle.

The speed increase control for the engine 19 includes a muffler filter regeneration control for raising the temperature of the exhaust gas to combust and remove the soot accumulated in the exhaust gas filter, a water temperature warming-up control for raising the temperature of cooling water in the radiator, and a hydraulic fluid temperature warming-up control for raising the temperature of the hydraulic fluid.

In the muffler filter regeneration control, the engine speed control section 39 gives, when a muffler filter regeneration control flag Ff set when the differential pressure across the muffler filter exceeds a threshold is transmitted from the engine controller 20, an engine speed command for raising the exhaust gas temperature of the muffler filter to the engine controller 20 to raise the engine speed, thereby combusting and removing the soot accumulated in the muffler filter.

In the water temperature warming-up control, the engine speed control section 39 gives, when the water temperature sensor value Tw transmitted from the engine controller 20 is less than a predetermined value, an engine speed command for raising the water temperature to the engine controller 20, thereby to raise the engine speed.

In the hydraulic fluid temperature warming-up control, the engine speed control section 39 gives, when the hydraulic fluid temperature sensor value To of the hydraulic fluid temperature sensor 32*b* is less than a predetermined value, an engine speed command for raising the hydraulic fluid temperature to the engine controller 20, thereby to raise the engine speed.

FIG. 7 is a flow chart depicting the processing contents of the engine speed control section 39.

In FIG. 7, the engine speed control section 39 converts the engine speed command voltage value v2 outputted from the engine speed voltage value computation section 38 into a target engine speed vw0 (step S10), and outputs the target engine speed vw0 to the pump flow rate correction computation section 41 and the surrounding detection monitor/alarm buzzer control section 42 as the primary target engine speed v3 (step S11).

Here, the relation between the engine speed command voltage value v2 and the target engine speed vw0 is a relation such that the engine speed is 800 rpm when the voltage value is 1 V, and that the engine speed is 1,800 rpm when the voltage value is 4 V.

Next, it is determined whether or not the inputted water temperature sensor value Tw is less than a threshold CT1 (for example, 25° C.) (step S12), and, if the determination result is YES, an engine speed set value Cw0 (for example, 2,000 rpm) for speed increase control for the engine 19 is outputted to the pump flow rate correction computation section 41 and the surrounding detection monitor/alarm buzzer control section 42 and the engine controller 13 as the secondary target engine speed v4 (step S13), whereas if the determination result is NO, the control proceeds to the next step. Subsequently, it is determined whether or not the sensor value To of the hydraulic fluid temperature sensor is less than a threshold CT2 (for example, 0° C.) (step S14), and, if the determination result is YES, the engine speed set value Cw0 for speed increase control for the engine 19 is outputted to the pump flow rate correction computation section 41 and the surrounding detection monitor/alarm buzzer control section 42 and the engine controller 13 as the secondary target engine speed v4 (step S13), whereas if the determination result is NO, the control proceeds to the next step. Next, it is determined whether or not the muffler filter regeneration control flag Ff is transmitted from the engine controller 20 (step S16), and, if the determination result is YES, the engine speed set value Cw0 for speed increase control for the engine 19 is outputted to the pump flow rate correction computation section 41 and the surrounding detection monitor/alarm buzzer control section 42 and the engine controller 13 as the secondary target engine speed v4 (step 13), whereas if the determination result is NO, the target engine speed vw0 converted from the engine speed command voltage v2 in step S10 is outputted to the pump flow rate correction computation section 41 and the surrounding detection monitor/alarm buzzer control section 42 and the engine controller 13 as the secondary target engine speed v4 (step S18).

<Pump Flow Rate Control Section 40>

Figure 8:
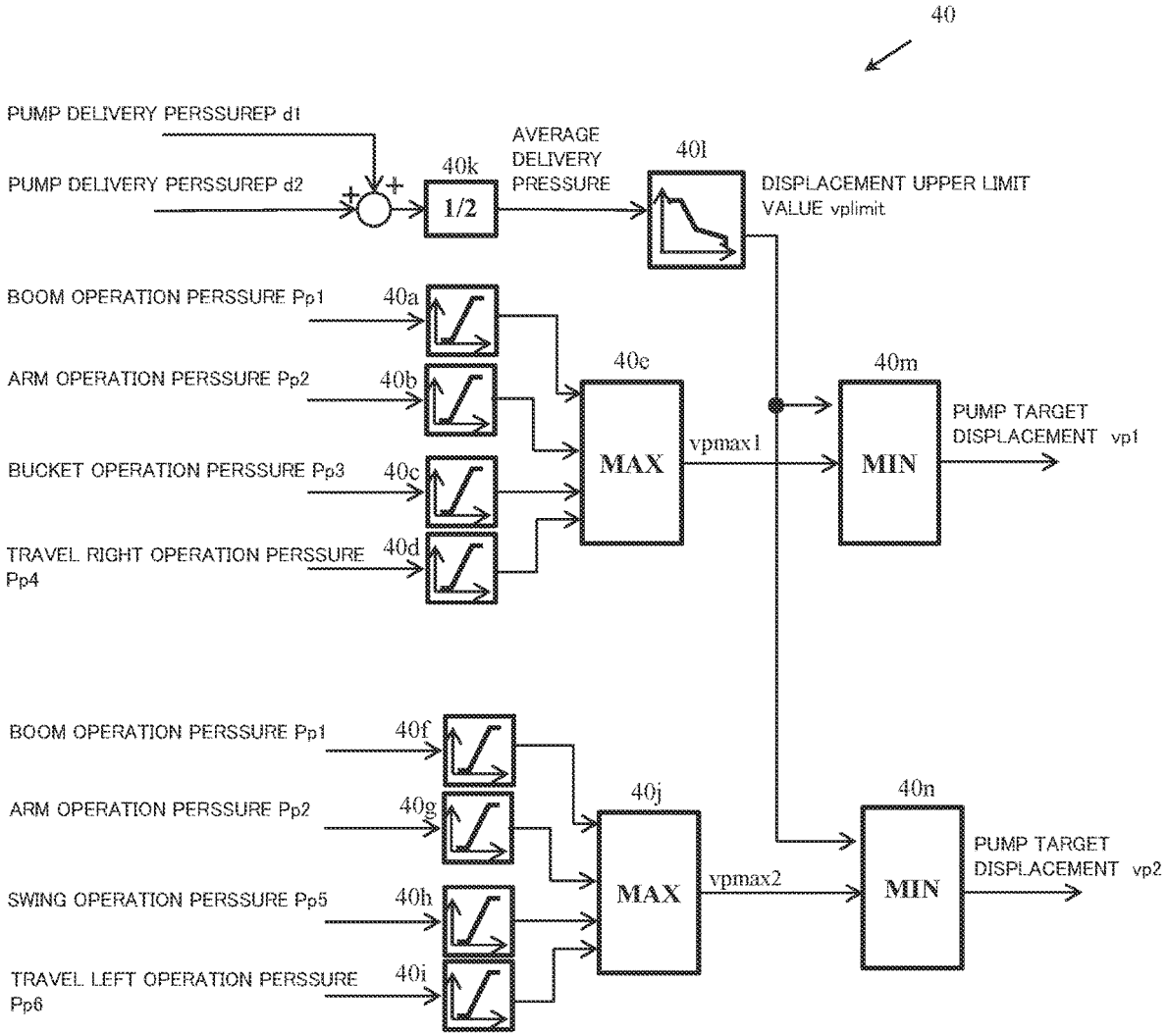
FIG. 8 is a functional block diagram depicting the processing contents of a pump flow rate control section.

FIG. 8 is a functional block diagram depicting the processing contents of the pump flow rate control section 40.

In FIG. 8, the pump flow rate control section 40 has first target pump displacement computation sections 40*a*, 40*b*, 40*c*, and 40*d* and a first maximum value selection section 40*e*, second target pump displacement computation sections 40*f*, 40*g*, 40*h*, and 40*i* and a second maximum value selection section 40*j*, an average delivery pressure computation section 40*k* and a pump displacement upper limit value computation section 40*l*, and first and second minimum value selection sections 40*m* and 40*n*, as control functions for calculating pump target displacements vp1 and vp2 of the first and second hydraulic pumps 21*a* and 21*b*.

The first target pump displacement computation sections 40*a*, 40*b*, 40*c*, and 40*d* compute respective target displacements from the boom operation pressure Pp1, the arm operation pressure Pp2, the bucket operation pressure Pp3, and the travel right operation pressure Pp4 sensed by the operation pressure sensors 27 and 28 and inputted to the pump flow rate control section 40, and the first maximum value selection section 40*e* selects a maximum value of the computed target displacements as a basic target displacement vpmax1 for the first hydraulic pump 21*a*.

The second target pump displacement computation sections 40*f*, 40*g*, 40*h*, and 40*i* similarly compute respective target displacements from the boom operation pressure Pp1, the arm operation pressure Pp2, the swing operation pressure Pp5, and the travel left operation pressure Pp6 sensed by the operation pressure sensors 26, 27, and 28 and inputted to the pump flow rate control section 40, and the second maximum value selection section 40*j* selects a maximum value of the computed target displacements as a basic target displacement vpmax2 for the second hydraulic pump 21*b*.

The average delivery pressure computation section 40*k* divides the sum of the pump delivery pressure Pd1 and the pump delivery pressure Pd2 sensed by the pump delivery pressure sensors 29*a* and 29*b* and inputted to the pump flow rate control section 40 by 2 to calculate an average delivery pressure, and the pump displacement upper limit value computation section 40*l* causes a maximum torque characteristic for preset torque limiting control for the hydraulic pumps 21*a* and 21*b* to refer the calculated average delivery pressure, and calculates a displacement upper limit value vplimit for the hydraulic pumps 21*a* and 21*b*.

The first minimum value selection section 40*m* selects a smaller value of the basic target displacement vpmax1 for the first hydraulic pump 21*a* and the displacement upper limit value vplimit, and generates a pump target displacement vp1 for the first hydraulic pump 21*a*. The second minimum value selection section 40*n* selects a smaller value of the basic target displacement vpmax2 for the second hydraulic pump 21*b* and the displacement upper limit value vplimit, and generates a pump target displacement vp2 for the second hydraulic pump 21*b*.

<Pump Flow Rate Correction Computation Section 41>

The pump flow rate correction computation section 41 performs, when the secondary target engine speed v4 calculated by the engine speed control section 39 is the engine speed set value Cw0 for speed increase control for the engine 19, a control for correcting the pump target displacements vp1 and vp2 to reduce the displacement volumes (delivery flow rates) of the hydraulic pumps 21*a* and 21*b*.

Figure 9:
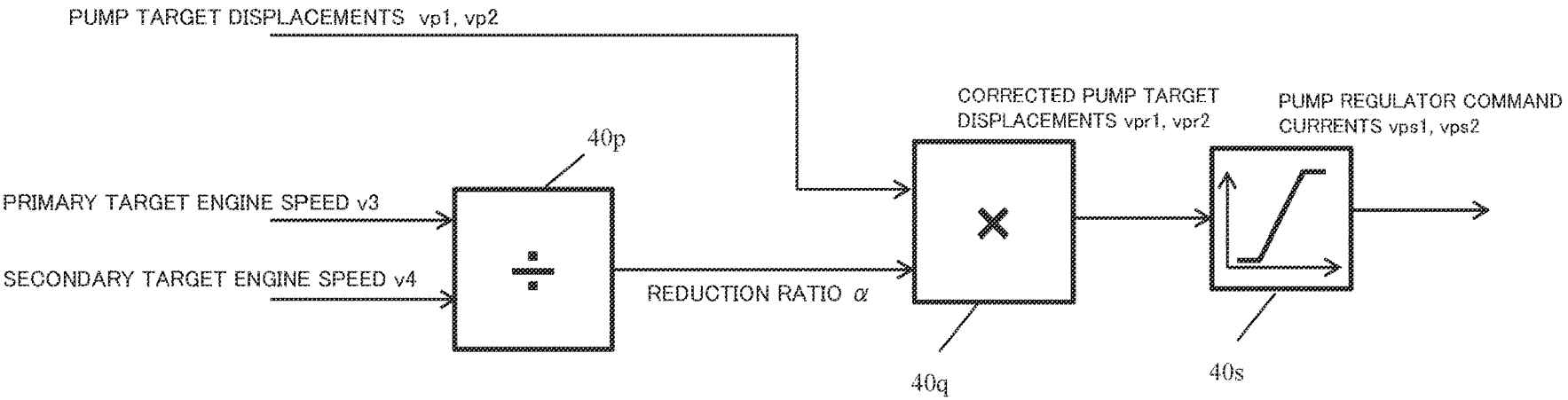
FIG. 9 is a functional block diagram depicting the processing contents of a pump flow rate correction computation section.

FIG. 9 is a functional block diagram depicting the processing contents of the pump flow rate correction computation section 41.

In FIG. 9, the pump flow rate correction computation section 41 has a division section 40*p*, a multiplication section 40*q*, and a regulator command value computation section 40*s*.

The division section 40*p* divides the primary target engine speed v3 calculated by the engine speed control section 39 by the secondary target engine speed v4, to calculate the ratio α (v3/v4) of the engine speed which is desired to be reduced.

The multiplication section 40*q* multiplies the pump target displacements vp1 and vp2 calculated in the pump flow rate control section 40 by the ratio α to calculate corrected pump target displacements vpr1 and vpr2, and, when the secondary target engine speed v4 is the engine speed set value Cw0 for speed increase control for the engine 19, performs correction so as to reduce the pump target displacements vp1 and vp2 with the ratio α.

The regulator command value computation section 40*s* converts the corrected pump target displacements vpr1 and vpr2 into command currents vps1 and vps2 for the regulators 24*a* and 24*b* of the hydraulic pumps 21*a* and 21*b*, and outputs the command currents vps1 and vps2.

As a result, when the secondary target engine speed v4 is the engine speed set value Cw0 for speed increase control for the engine 19, the displacement volumes (delivery flow rates) of the hydraulic pumps 21*a* and 21*b* are reduced by an amount corresponding to the amount by which the engine speed is desired to be reduced (ratio α), whereby operation limiting for the machine body can be performed while reducing the driving speeds of the hydraulic actuators (the travel motors 1*c* and 1*d*, the swing motor 2*a*, the boom cylinder 3*d*, the arm cylinder 3*e*, and the bucket cylinder 3*f*) and performing speed increase control for the engine 19.

<Surrounding Detection Monitor/Alarm Buzzer Control Section 42>

Figure 10:
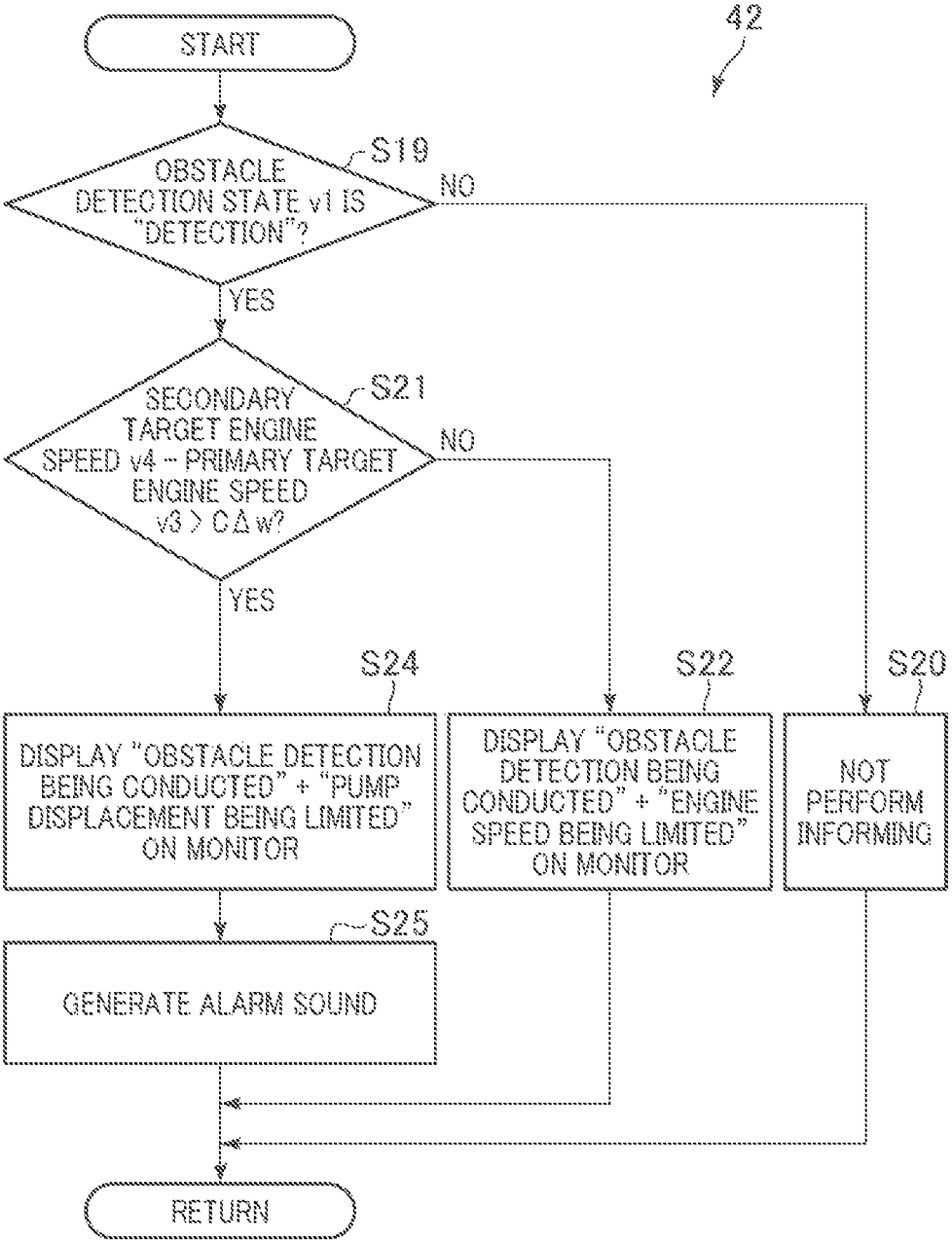
FIG. 10 is a flow chart depicting the processing contents of a surrounding detection monitor/alarm buzzer control section.

FIG. 10 is a flow chart depicting the processing contents of the surrounding detection monitor/alarm buzzer control section 42.

In FIG. 10, the surrounding detection monitor/alarm buzzer control section 42 first determines whether or not the obstacle detection state v1 inputted to the surrounding detection monitor/alarm buzzer control section 42 from the detection determination section 37 is "detection" (step S19), and, if the determination result is not "detection," sends a command to the surrounding detection monitor 30 and the alarm buzzer 31 so as not to cause the surrounding detection monitor 30 and the alarm buzzer 31 to perform informing (so as not to display an alarm on a screen display section of the surrounding detection monitor 30 and not to cause the alarm buzzer 31 to generate an alarm sound) (step S20). Next, the surrounding detection monitor/alarm buzzer control section 42 takes a difference Δv (=v4−v3) between the primary target engine speed v3 and the secondary target engine speed v4 inputted from the engine speed control section 39, and performs comparison so as to determine whether or not the difference Δv is greater than a threshold CΔw (for example, 10 rpm) (step S21). The threshold CΔw is a determination value for determining whether or not the primary target engine speed v3 and the secondary target engine speed v4 can be deemed as the same value. If the difference Δv is equal to or less than the threshold CΔw, the secondary target engine speed v4 is not the engine speed set value Cw0 for speed increase control for the engine 19, but speed lowering control for the engine 19 is being conducted, and, therefore, "obstacle detection being conducted" and "engine speed being limited" are displayed on the screen display section of the surrounding detection monitor 30 (step S22). If the difference Δv is greater than CΔv, the secondary target engine speed v4 is the engine speed set value Cw0 for speed increase control for the engine 19, and the status is operation limiting control for the machine body by flow rate reduction control for the hydraulic pumps 21*a* and 21*b*, and, therefore, "obstacle detection being conducted" and "pump displacement being limited" are displayed on the screen display section of the surrounding detection monitor 30 (step 24), and a command is outputted to the alarm buzzer 31 so as to generate an alarm sound (step S25).

<Advantages>

According to the present embodiment, when the 3D sensors 5 to 8 which are obstacle sensors sense an obstacle and engine speed increase control is to be conducted, the machine controller 13 (controller) performs supply flow rate reduction control for reducing the flow rates of the hydraulic fluid supplied to the plurality of hydraulic actuators 1*c* to 3*f* from the hydraulic pump 21 to thereby perform operation limiting control for the machine body, and therefore, the operation limiting control can be conducted without damaging the engine speed increase control, and both a control for limiting the operation of the machine body and a control for increasing the engine speed can be realized simultaneously. Consequently, approaching of the machine body to an obstacle in the surroundings can be avoided, even when engine speed increase control is being performed.

In addition, the machine controller 13 (controller) performs, when the 3D sensors 5 to 8 which are obstacle sensors detect an obstacle and engine speed increase control is not to be conducted, a control for lowering the speed of the engine 19 to thereby perform the operation limiting control; therefore, the operator can know the obstacle detection state by a change in the engine sound, approaching of the machine body to an obstacle in the surroundings can be avoided, and operation can be performed safely.

Further, the machine controller 13 (controller) performs, when the 3D sensors 5 to 8 which are obstacle sensors sense an obstacle and engine speed increase control is to be conducted, supply flow rate reduction control to thereby perform operation limiting control for the machine body, and, simultaneously, operates the alarm device (alarm buzzer 31) to generate an alarm sound. As a result, even where the operation limiting control for the machine body is being conducted by performing the supply flow rate reduction control, like in the case where the operation limiting control is being conducted by performing a control of lowering the speed of the engine 19, the operator can know the obstacle detection state by a change in the sound (generation of an alarm sound), and, in this case also, the operator can avoid approaching of the machine body to an obstacle in the surroundings, and can perform operation safely.

Second Embodiment

A second embodiment of the present invention will be described.

The system configuration of the present embodiment differs from that of the first embodiment in the following points.

In the present embodiment, in the case of performing operation limiting control for the machine body by supply flow rate reduction control, the supply flow rate reduction control is conducted not by a control for reducing the delivery flow rate of the hydraulic pump 21, but by a control for limiting the operations of a plurality of directional control valves provided in the control valve 22.

The details will be described below.

Figure 11:
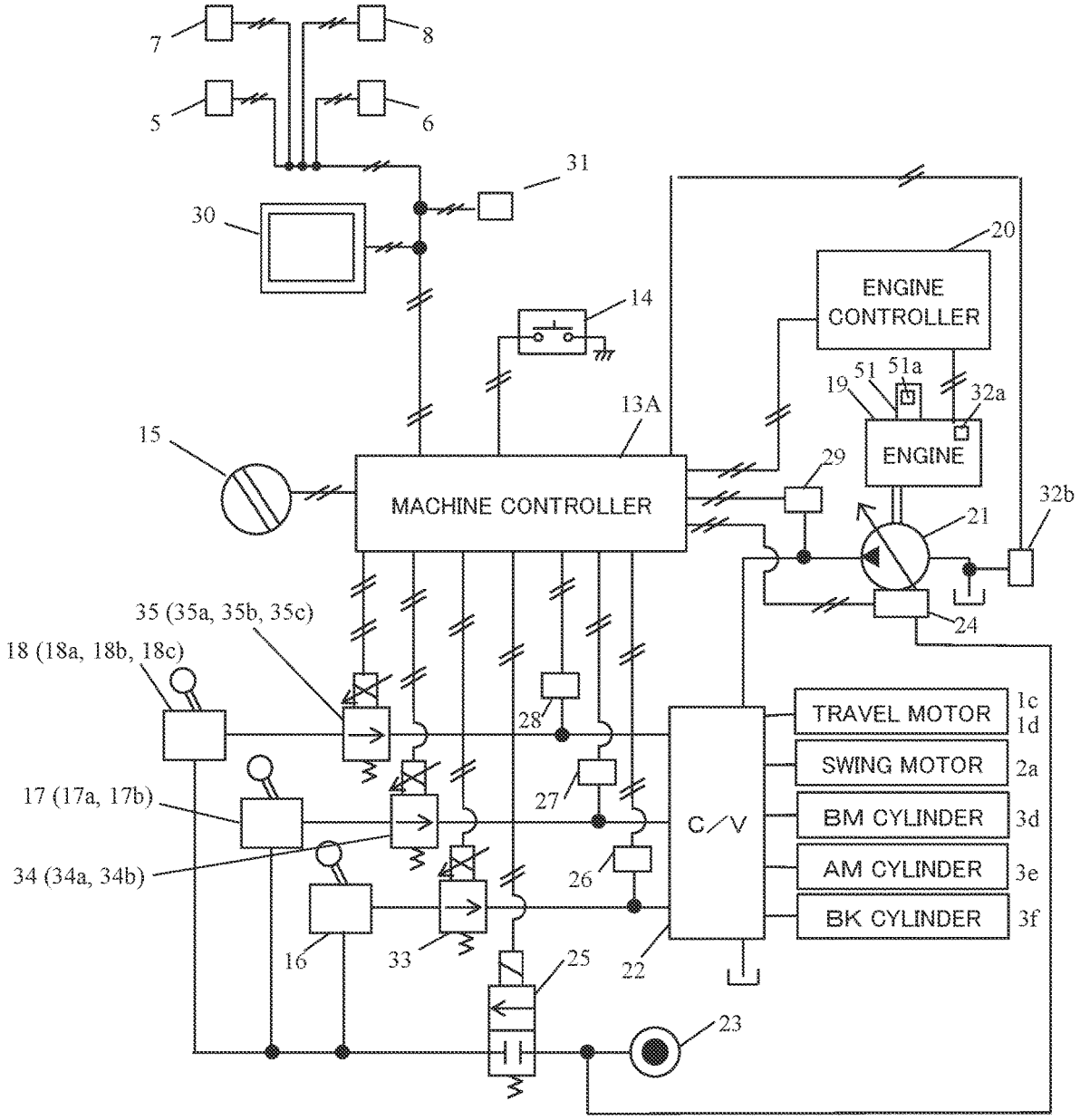
FIG. 11 is a diagram depicting the system configuration of a construction machine according to a second embodiment of the present invention.

FIG. 11 is a diagram depicting the system configuration of a construction machine according to the second embodiment of the present invention.

In FIG. 11, a swing operation pressure limiting solenoid valve 33 is provided, as one of means for performing operation limiting of swing, in a pilot line between the swing operation lever device 16 and the control valve 22. The swing operation pressure limiting solenoid valve 33 is in a communicating state at the non-control time (0 mA), and the operation pressure is reduced (limited) by enlargement of a command current outputted by the machine controller 13A, whereby a swing operation is limited.

In addition, a travel operation pressure limiting solenoid valve 34 is provided, as one of means for performing operation limiting of travel, in a pilot line between the travel operation lever device 17 and the control valve 22. The travel operation pressure limiting solenoid valve 34 is in a communicating state at the non-control time (0 mA), and the operation pressure is reduced (limited) by enlargement of a command current outputted by the machine controller 13A, whereby a travel operation is limited. The travel operation pressure limiting solenoid valve 34 includes a limiting solenoid valve 34*a* for left travel operation pressure and a limiting solenoid valve 34*b* for right travel operation pressure.

Further, a front implement operation pressure limiting solenoid valve 35 is provided, as one of means for performing operation limiting of the front work implement 3, in a pilot line between the front implement operation lever device 18 and the control valve 22. The front implement operation pressure limiting solenoid valve 35 is in a communicating state at the non-control time (0 mA), and the operation pressure is reduced (limited) by enlargement of a command current outputted by the machine controller 13A, whereby a front implement operation is limited. The front implement operation pressure limiting solenoid valve 35 includes a limiting solenoid valve 35*a* for boom operation pressure, a limiting solenoid valve 35*b* for arm operation pressure, and a limiting solenoid valve 35*c* for bucket operation pressure.

Figure 12:
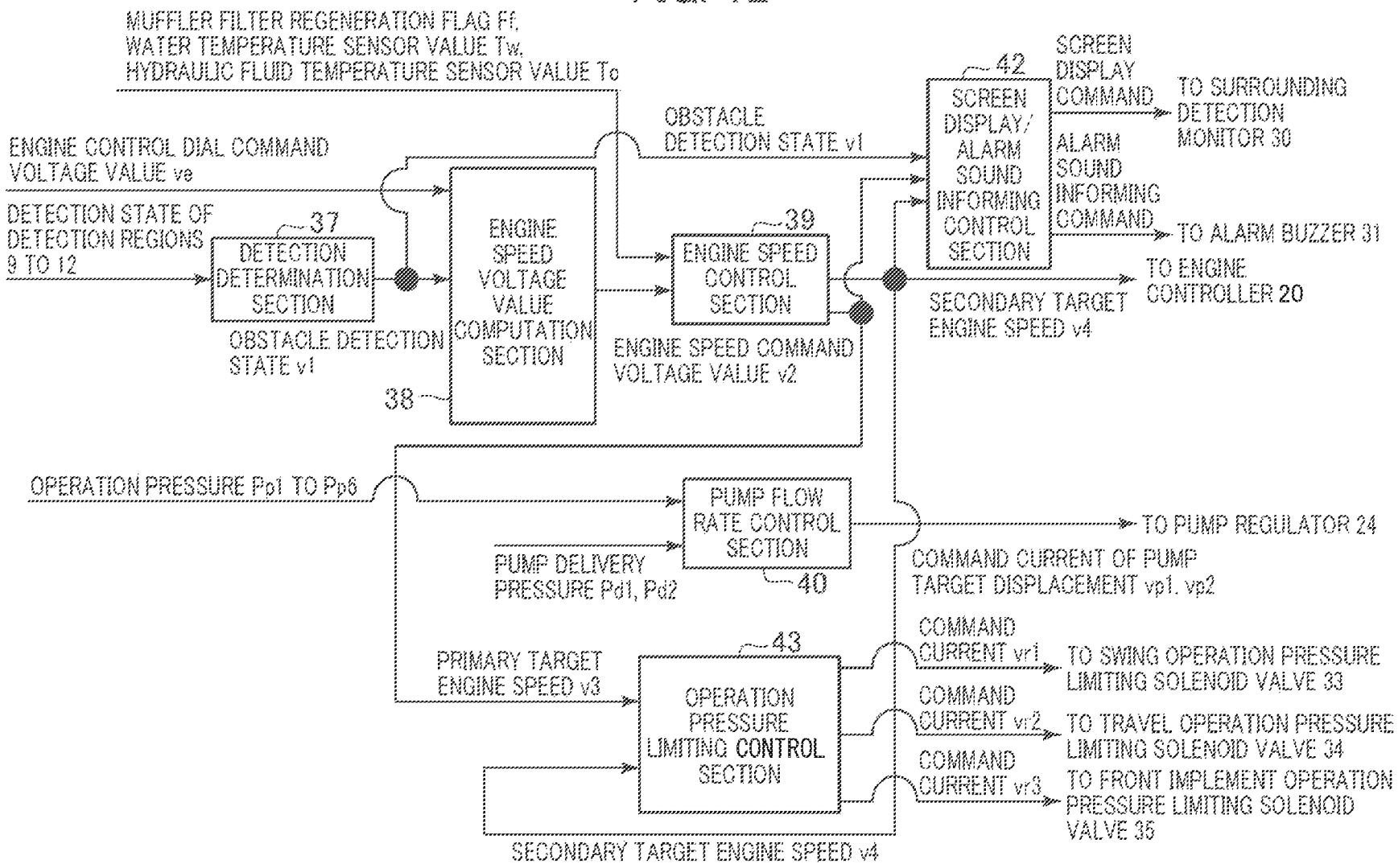
FIG. 12 is a block diagram depicting a control function according to machine body operation limiting at the time of sensing of an obstacle of a machine controller in the second embodiment.

FIG. 12 is a block diagram depicting control functions concerning machine operation limiting at the time of obstacle sensing of the machine controller 13A according to the second embodiment.

In FIG. 12, the machine controller 13A has the same control functions as depicted in FIG. 4 of the first embodiment until the engine speed control section 39 outputs the primary target engine speed v3 and the secondary target engine speed v4. The machine controller 13A differs from the first embodiment in that it includes an operation pressure limiting control section 43 in place of the pump flow rate correction computation section 41, inputs the primary target engine speed v3 and the secondary target engine speed v4 not to the pump flow rate correction computation section 41 but to the operation pressure limiting control section 43, and outputs command currents to the limiting solenoid valves 33, 34, and 35 of operation pressure.

Figure 13:
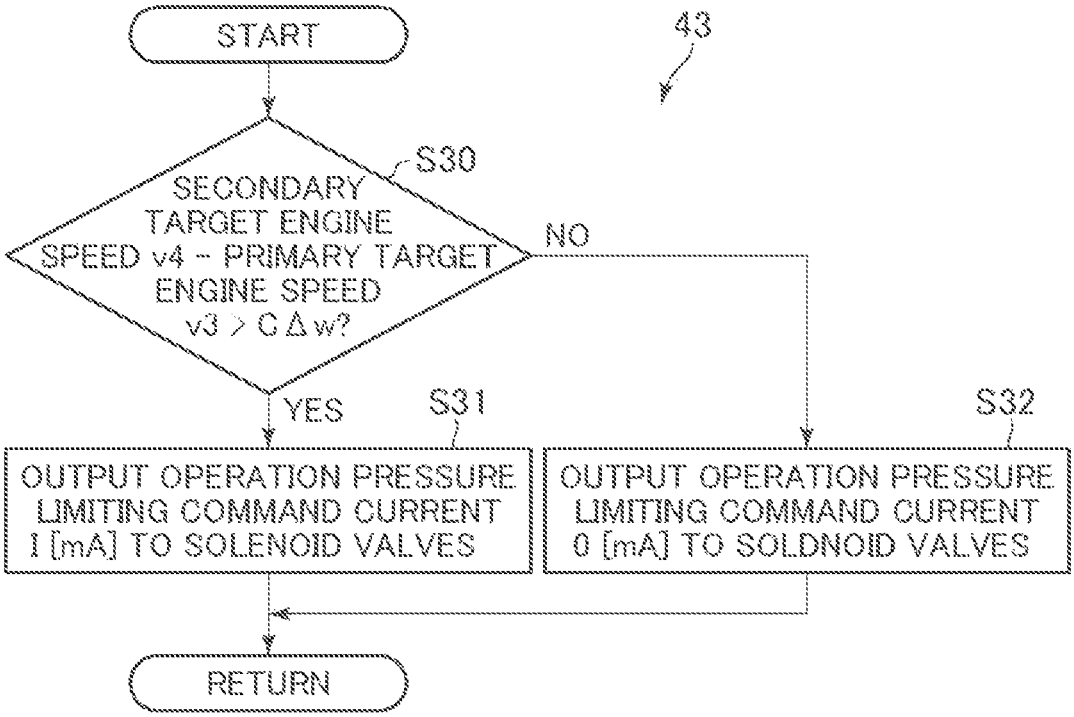
FIG. 13 is a flow chart depicting the processing contents of an operation pressure limiting control section in the second embodiment.

FIG. 13 is a flow chart depicting the processing contents of the operation pressure limiting control section 43.

In FIG. 13, the operation pressure limiting control section 43 first takes a difference Δv (=v4−v3) between the primary target engine speed v3 and the secondary target engine speed v4, and performs comparison such as to determine whether or not the difference Δv is greater than a threshold CΔw (for example, 10 rpm) (step S30). If the difference Δv is greater than the threshold CΔw, the secondary target engine speed v4 is deemed as an engine speed set value Cw0 for speed increase control for the engine 19 (as being in the course of speed increase control for the engine 19), and command currents (limiting command currents) vr1, vr2, and vr3 of operation pressure limiting of I [mA] are outputted to the swing operation pressure limiting solenoid valve 33, the travel operation pressure limiting solenoid valve 34, and the front implement operation pressure limiting solenoid valve 35 (step S31). In this instance, the limiting command currents vr1, vr2, and vr3 are currents of a magnitude of a value such as to be equivalent to an operation speed where the operation of the hydraulic actuators is limited by lowering the engine speed during obstacle detection. If the difference Δv is equal to or less than the threshold CΔw, the secondary target engine speed v4 is deemed as not the engine speed set value Cw0 for speed increase control for the engine 19 (as not being in the course of speed increase control for the engine 19), and the command currents vr1, vr2, and vr3 of 0 [mA] are outputted to the swing operation pressure limiting solenoid valve 33, the travel operation pressure limiting solenoid valve 34, and the front implement operation pressure limiting solenoid valve 35 (step S32).

<Advantages>

According to the present embodiment, also, in the case of performing operation limiting control for the machine body by supply flow rate reduction control, the supply flow rate reduction control is conducted not by a control for reducing the delivery flow rate of the hydraulic pump 21 but by a control for limiting the operations of a plurality of directional control valves provided in the control valve 22, whereby advantageous effects equivalent to those of the first embodiment are obtained.

Third Embodiment

A third embodiment of the present invention will be described.

Figure 14:
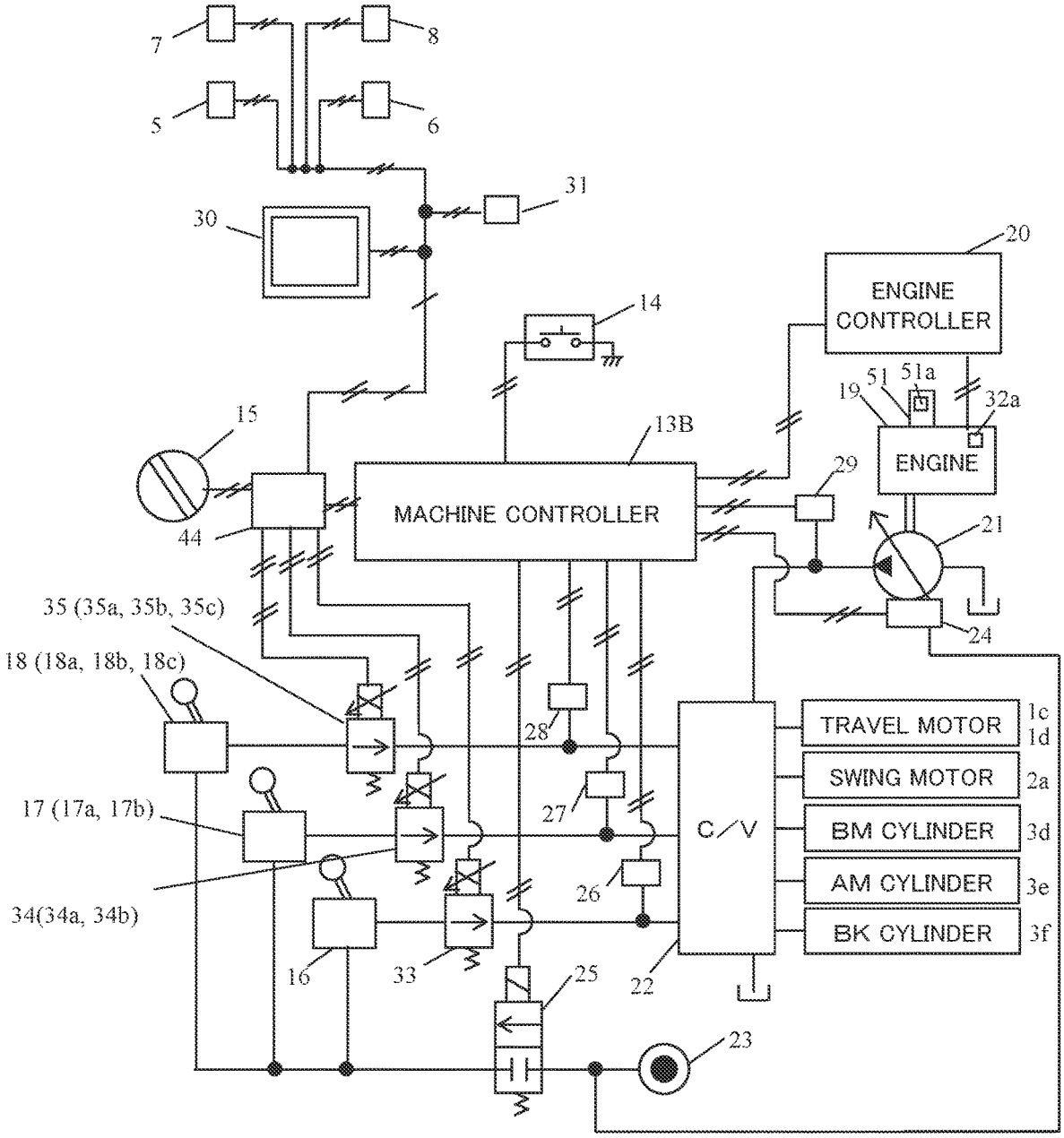
FIG. 14 is a diagram depicting the system configuration of a construction machine according to a third embodiment of the present invention.

FIG. 14 is a diagram depicting the system configuration of a construction machine according to the third embodiment of the present invention.

The system configuration of the present embodiment differs from those of the first and second embodiments in the following points.

In the first and second embodiments, the controller that performs operation limiting control and engine speed increase control has been the machine controller 13 or 13A. In the present embodiment, on the other hand, the controller includes a machine controller 13B and an operation limiting controller 44 provided separately from the machine controller 13B, in which the machine controller 13B performs a control for setting a speed of the engine 19 based on an instruction from the engine control dial 15 and engine speed increase control, and the operation limiting controller 44 performs operation limiting control.

The details will be described below.

In FIG. 14, the construction machine (hydraulic excavator) of the present embodiment includes an operation limiting controller 44 provided separately from the machine controller 13B.

The operation limiting controller 44 is connected with the machine controller 13B by CAN communication. The operation limiting controller 44 outputs an engine speed command voltage vf corresponding to an engine control voltage to the machine controller 13B by CAN communication, and the engine speed command voltage vf and a target engine speed vw1 that is determined based on speed of engine speed increase control and that is also a speed command value for the engine controller 20 are inputted from the machine controller 13B to the operation limiting controller 44.

In addition, the engine control dial 15 is connected with the operation limiting controller 44, and the operation limiting controller 44 directly receives the voltage value ve of the engine control dial 15 as an input. Then, the operation limiting controller 44 outputs the engine speed command voltage vf determined based on the inputted voltage value ve to the machine controller 13B by CAN communication.

Further, the operation limiting controller 44 is connected with the 3D sensors 5 to 8 which are obstacle sensors, the surrounding detection monitor 30 and the alarm buzzer 31 by CAN communication, receives the obstacle detection state as an input and outputs an alarm informing command. Besides, the operation limiting controller 44 is connected with the operation pressure limiting solenoid valves 33, 34, and 35 that limit the operation pressures generated by the operation lever devices 16, 17, and 18 to thereby limit the operations of the hydraulic actuators 1*c* to 3*f*, and, like in the second embodiment, outputs the command currents vr1, vr2, and vr3 of operation pressure limiting to the operation pressure limiting solenoid valves 33, 34, and 35.

Figure 15:
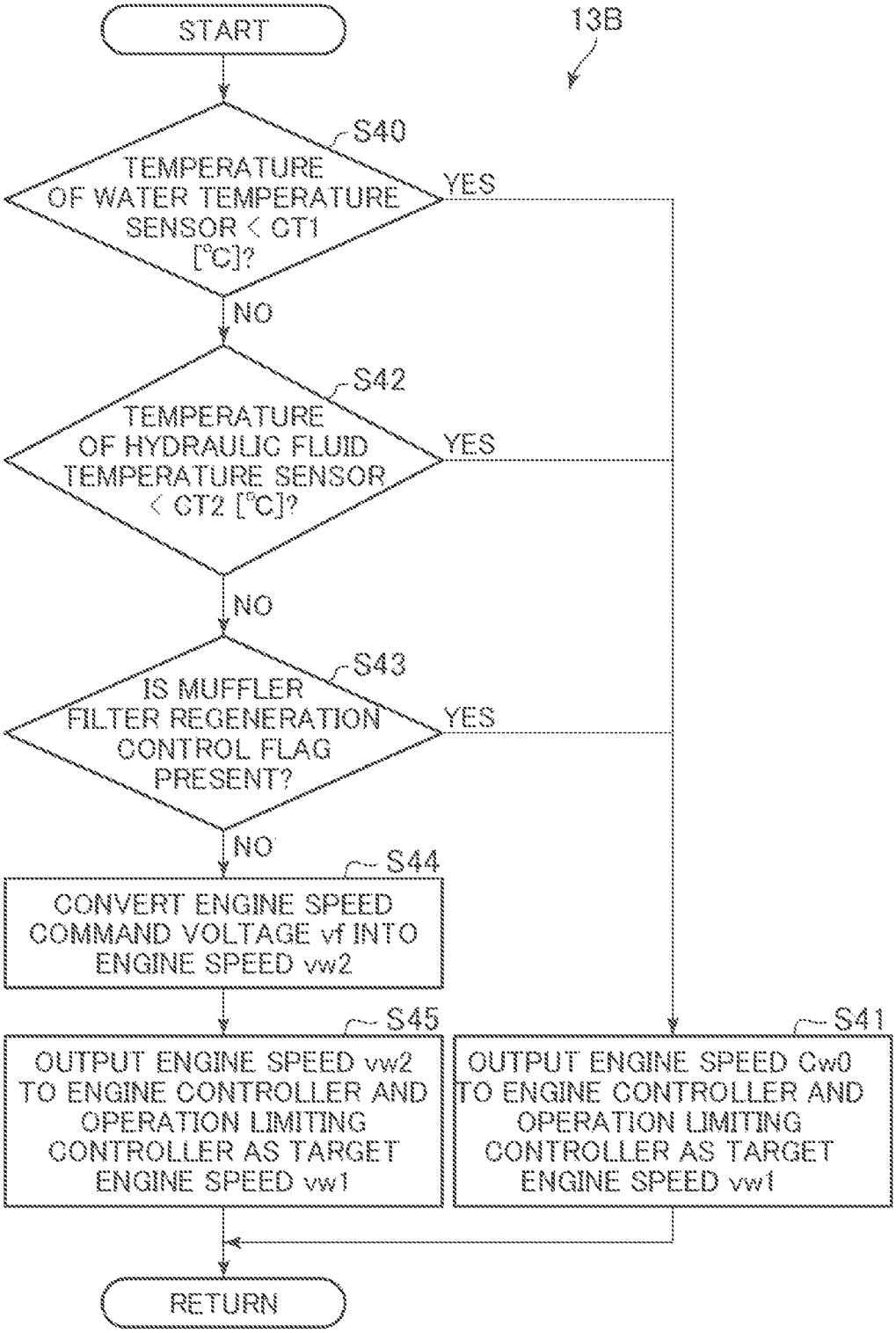
FIG. 15 is a flow chart depicting a part concerning an engine speed command value in the machine controller.

FIG. 15 is a flow chart depicting that part of the processing contents of the machine controller 13B which concerns the engine speed command value.

In FIG. 15, the machine controller 13B determines whether or not the inputted water temperature sensor value Tw is less than a threshold CT1 (for example, 25° C.) (step S40), and, if the water temperature sensor value Tw is less than the threshold CT1, outputs an engine speed set value Cw0 (for example, 2,000 rpm) for speed increase control for the engine 19 to the engine controller 20 and the operation limiting controller 44 as a target engine speed vw1 (step S41), whereas if the water temperature sensor value Tw is equal to or more than the threshold CT1, the control proceeds to the next step. Next, the machine controller 13B determines whether or not the hydraulic fluid temperature sensor value To is less than a threshold CT2 (for example, 0° C.) (step S42), and, if the hydraulic fluid temperature sensor value To is less than the threshold CT2, outputs the engine speed set value Cw0 for speed increase control for the engine 19 to the engine controller 20 and the operation limiting controller 44 as a target engine speed vw1 (step S41), whereas if the hydraulic fluid temperature sensor value To is equal to or more than the threshold CT2, the control proceeds to the next step. Subsequently, the machine controller 13B determines whether or not a muffler filter regeneration control flag Ff is transmitted from the engine controller 20 (step S43), and, if the muffler filter regeneration control flag Ff is transmitted from the engine controller 20, outputs the engine speed set value Cw0 for speed increase control for the engine 19 to the engine controller 20 and the operation limiting controller 44 as a target engine speed vw1 (step S41). If the muffler filter regeneration control flag Ff is not transmitted from the engine controller 20, the machine controller 13B receives as an input the engine speed command voltage vf from the operation limiting controller 44 in step S44, converts the inputted engine speed command voltage vf into an engine speed vw2, and outputs the converted engine speed vw2 to the engine controller 20 and the operation limiting controller 44 as a target engine speed vw1 (step S45).

Figure 16:
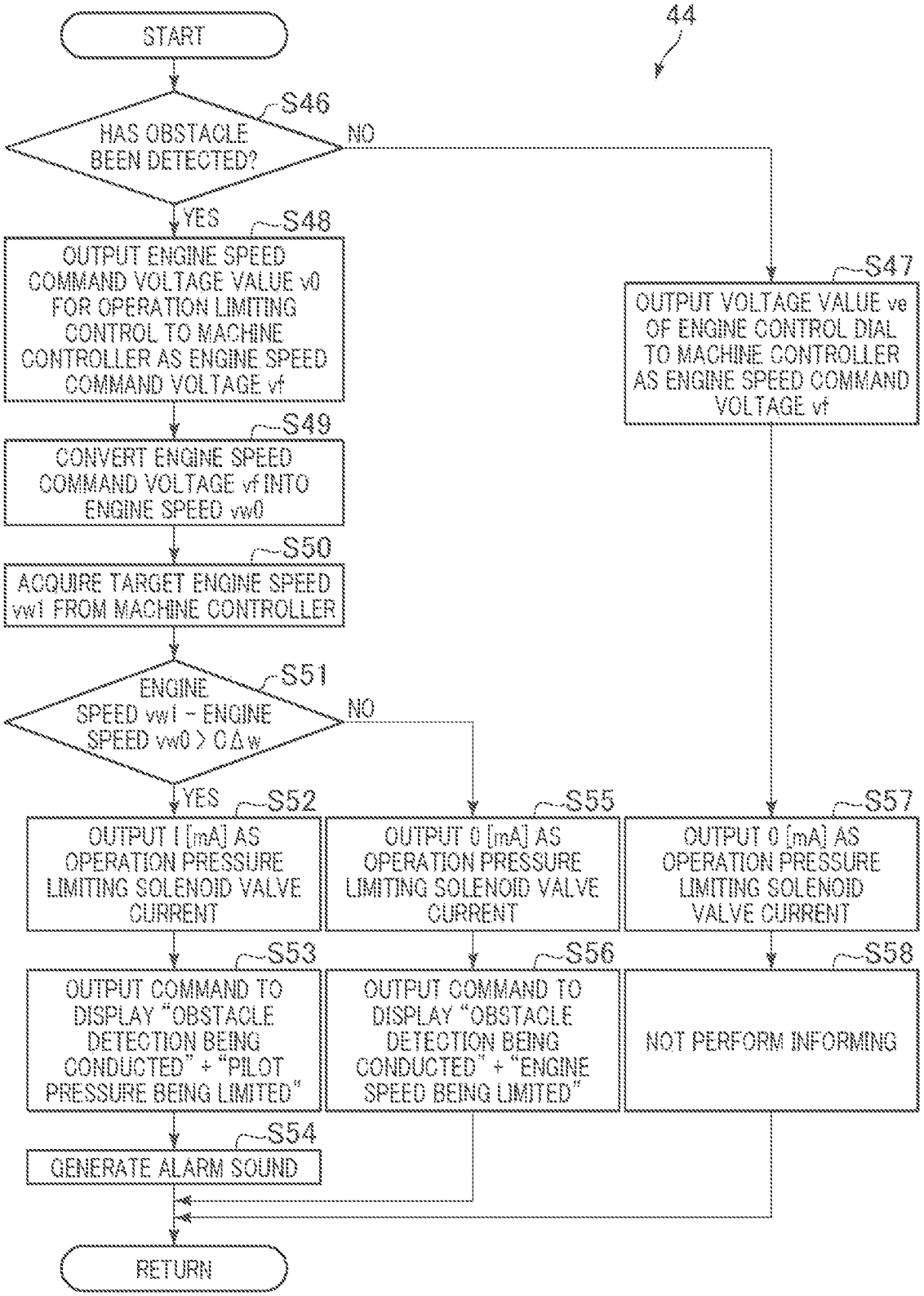
FIG. 16 is a flow chart depicting the processing contents of an operation limiting controller.

FIG. 16 is a flow chart depicting the processing contents of the operation limiting controller 44.

In FIG. 16, the operation limiting controller 44 first determines whether or not an obstacle has been detected (step S46), and, if the obstacle is detected, the control proceeds to step S48, whereas if the obstacle has not been detected, the control proceeds to step S47. In step S48, a command voltage value v0 for operation limiting control (engine speed limiting control) preset is outputted to the machine controller 13B as an engine speed command voltage vf, and the control proceeds to step S49. In step S49, an engine speed command voltage of is converted into a target engine speed vw0, and the control proceeds to step S50. In step S50, a target engine speed vw1 is acquired from the machine controller 13B, and the control proceeds to step S51. In step S51, the difference Δv (=vw1−vw0) between the target engine speed vw0 and the target engine speed vw1 is taken, comparison such as to determine whether or not the difference Δv is greater than a threshold CΔw (for example, 10 rpm) is performed, and, if the difference Δv is greater than the threshold CΔw, the control proceeds to step S52, whereas if the difference Δv is smaller than the threshold CΔw, the control proceeds to step S55. In step S52, command currents vr1, vr2, and vr3 for operation pressure limiting of I [mA] are outputted to the swing operation pressure limiting solenoid valve 33, the travel operation pressure limiting solenoid valve 34, and the front implement operation pressure limiting solenoid valve 35. In the next step S53, a command for displaying "obstacle detection being conducted" and "pilot pressure being limited" on the screen display section of the surrounding detection monitor 30 is outputted, and a command for causing the alarm buzzer 31 to generate an alarm sound is outputted (step S54). In step S55, command currents vr1, vr2, and vr3 for operation pressure limiting of 0 [mA] are outputted to the swing operation pressure limiting solenoid valve 33, the travel operation pressure limiting solenoid valve 34, and the front implement operation pressure limiting solenoid valve 35. In addition, a command for displaying "obstacle detection being conducted" and "engine speed being limited" on the screen display section of the surrounding detection monitor 30 is outputted (step S56).

In step S47, a voltage value ve of the engine control dial 15 is outputted to the machine controller 13B as an engine speed command voltage vf, and the control proceeds to step S57. In step S57, command currents vr1, vr2, and vr3 for operation pressure limiting of 0 [mA] is outputted to the swing operation pressure limiting solenoid valve 33, the travel operation pressure limiting solenoid valve 34, and the front implement operation pressure limiting solenoid valve 35, and in step S58, a command is outputted to the surrounding detection monitor 30 and the alarm buzzer 31 such that the surrounding detection monitor 30 and the alarm buzzer 31 do not perform informing.

<Advantages>

According to the third embodiment, also, advantageous effects similar to those of the first embodiment are obtained.

In addition, according to the third embodiment, the operation limiting controller 44 is provided separately from the machine controller 13B, and the machine controller 13B performs a control of engine speed based on an instruction from the engine control dial 15 and engine speed increase control, and, therefore, a function of operation limiting control can be added, without modifying the existing engine control system.

Note that in the third embodiment, the supply flow rate reduction control for performing operation limiting for the machine body has been conducted by limiting the operations of the plurality of directional control valves, but, like in the first embodiment, it may be conducted by reducing the target displacement of the hydraulic pump 21 and reducing the delivery flow rate of the hydraulic pump 21.

DESCRIPTION OF REFERENCE CHARACTERS

1: Lower travel structure
1*c*, 1*d*: Travel motor (hydraulic actuator)
2: Upper swing structure
2*a*: Swing motor (hydraulic actuator)
3: Front work implement
3*d*: Boom cylinder (hydraulic actuator)

3*e*: Arm cylinder (hydraulic actuator)
3*f*: Bucket cylinder (hydraulic actuator)
4: Cabin
5 to 8: 3D sensor (obstacle sensor)
9 to 12: Detection region
13, 13A, 13B: Machine controller (controller)
14: Lock switch
15: Engine control dial
16: Swing operation lever device
17: Travel operation lever device
18: Front implement operation lever device
19: Engine
20: Engine controller
21, 21*a*, 21*b*: Hydraulic pump
22: Control valve (directional control valve)
23: Hydraulic fluid pressure source
24, 24*a*, 24*b*: Pump regulator
25: Lock valve
26: Swing operation pressure sensor
27: Travel operation pressure sensor
27*a*: Left travel operation pressure sensor
27*b*: Right travel operation pressure sensor
28: Front implement operation pressure sensor
28*a*: Boom operation pressure sensor
28*b*: Arm operation pressure sensor
28*c*: Bucket operation pressure sensor
29, 29*a*, 29*b*: Pump delivery pressure sensor
30: Surrounding detection monitor
31: Alarm buzzer
32*a*: Water temperature sensor
32*b*: Hydraulic fluid temperature sensor
33: Swing operation pressure limiting solenoid valve
34: Travel operation pressure limiting solenoid valve
34*a*: Limiting solenoid valve for left travel operation pressure
34*b*: Limiting solenoid valve for right travel operation pressure
35: Front implement operation pressure limiting solenoid valve
35*a*: Limiting solenoid valve for boom operation pressure
35*b*: Limiting solenoid valve for arm operation pressure
35*c*: Limiting solenoid valve for bucket operation pressure
37: Detection determination section
38: Engine speed voltage value computation section
39: Engine speed control section
40: Pump flow rate control section
41: Pump flow rate correction computation section
42: Surrounding detection monitor/alarm buzzer control section
43: Operation pressure limiting control section
44: Operation limiting controller (controller)

The invention claimed is:

1. A construction machine comprising:

an engine mounted on a machine body;

a variable displacement hydraulic pump driven by the engine;

a plurality of hydraulic actuators driven by an hydraulic fluid delivered from the hydraulic pump;

a plurality of directional control valves that control the flow rates of the hydraulic fluid supplied to the hydraulic actuators from the hydraulic pump;

an obstacle sensor that senses an obstacle in surroundings of the machine body; and a controller that performs operation limiting control for limiting operation of the machine body when the obstacle is sensed by the obstacle sensor, wherein the controller is configured to:

perform the operation limiting control by performing control for reducing a speed of the engine when the machine body does not require engine speed increase control for increasing the speed of the engine and when the obstacle is sensed by the obstacle sensor, and perform the operation limiting control by performing supply flow rate reduction control for reducing the flow rates of the hydraulic fluid supplied to the plurality of hydraulic actuators from the hydraulic pump when the machine body requires the engine speed increase control and when the obstacle is sensed by the obstacle sensor.

2. The construction machine according to claim 1, further comprising: an alarm device that generates an alarm sound, wherein the controller, when performing the supply flow rate reduction control, simultaneously operates the alarm device to generate the alarm sound.

3. The construction machine according to claim 1, wherein the controller includes a machine controller, and an operation limiting controller provided separately from the machine controller, wherein the machine controller performs the engine speed increase control, and wherein the operation limiting controller performs the operation limiting control.

4. The construction machine according to claim 1, wherein the engine speed increase control is at least one of water temperature warming-up control for raising temperature of cooling water circulated in the engine, hydraulic fluid warming-up control for raising temperature of a hydraulic fluid that is the hydraulic fluid supplied to the hydraulic actuators from the hydraulic pump, and exhaust gas temperature raising control for raising temperature of an exhaust gas of the engine and regenerating a filter of an exhaust gas after-processing device.

5. The construction machine according to claim 1, wherein the supply flow rate reduction control is a control for reducing a target displacement of the hydraulic pump and reducing the delivery flow rate of the hydraulic pump.

6. The construction machine according to claim 1, wherein the supply flow rate reduction control is a control for limiting operations of the plurality of directional control valves and reducing the flow rates of the hydraulic fluid supplied to the plurality of hydraulic actuators.

7. The construction machine according to claim 1, wherein the controller is configured to perform the engine speed increase control and perform the supply flow rate reduction control when the machine body requires the engine speed increase control and an obstacle is sensed by the obstacle sensor.

* * * * *